US010036162B2

(12) United States Patent
Geiger

(10) Patent No.: US 10,036,162 B2
(45) Date of Patent: Jul. 31, 2018

(54) RECESSED SHADE AND CURTAIN STORAGE AND DEPLOYMENT SYSTEM

(71) Applicant: Geigtech East Bay LLC, Charleston, SC (US)

(72) Inventor: James Geiger, Charleston, SC (US)

(73) Assignee: Geigtech East Bay LLC, Charleston, SC (US)

( * ) Notice: Subject to any disclaimer, the term of this patent is extended or adjusted under 35 U.S.C. 154(b) by 0 days.

(21) Appl. No.: 15/694,985

(22) Filed: Sep. 4, 2017

(65) Prior Publication Data

US 2017/0362827 A1 Dec. 21, 2017

Related U.S. Application Data

(63) Continuation-in-part of application No. 14/970,117, filed on Dec. 15, 2015, now Pat. No. 9,840,868.

(60) Provisional application No. 62/092,488, filed on Dec. 16, 2014.

(51) Int. Cl.

| | |
|---|---|
| ***E06B 9/42*** | (2006.01) |
| ***E04B 9/00*** | (2006.01) |
| ***A47H 1/104*** | (2006.01) |
| *A47H 1/13* | (2006.01) |

(52) U.S. Cl.

CPC ..... *E04B 9/003* (2013.01); *A47H 1/104* (2013.01); *E06B 9/42* (2013.01); *A47H 1/13* (2013.01)

(58) Field of Classification Search

CPC .. A47H 1/13; A47H 1/104; E06B 9/42; E04B 9/003

See application file for complete search history.

(56) References Cited

U.S. PATENT DOCUMENTS

| | | | | | |
|---|---|---|---|---|---|
| 3,346,909 | A * | 10/1967 | Blackburn | A47H 1/104 | 16/94 D |
| 3,467,460 | A | 9/1969 | Acker | | |
| 3,710,530 | A * | 1/1973 | Valtonen | E04B 9/064 | 174/491 |
| 4,023,235 | A * | 5/1977 | Cohen | A47H 1/04 | 16/94 D |

(Continued)

FOREIGN PATENT DOCUMENTS

AU 2011265446 A1 7/2012

OTHER PUBLICATIONS

U.S. Appl. No. 29/512,034, filed Dec. 16, 2014, Geiger.

(Continued)

*Primary Examiner* — Babajide A Demuren
(74) *Attorney, Agent, or Firm* — Foley & Lardner LLP

(57) ABSTRACT

A shade and curtain storage and deployment system includes a shade assembly, a curtain assembly, and an access panel, each disposed within a recess formed in a ceiling. A visible surface of the access panel occupies the same plane as a visible surface of the ceiling. The curtain assembly includes a track having a plurality of hangers configured to translate on the track and support a curtain. A first gap provided between a first edge of the access panel and the ceiling is configured to enable a shade of the shade assembly to extend from the recess to an area below the ceiling. A second gap provided between a second edge of the access panel and the ceiling is configured to enable the curtain to extend along the second edge. The track extends along the second edge and is disposed entirely above the plane.

20 Claims, 19 Drawing Sheets

(56) References Cited

U.S. PATENT DOCUMENTS

| | | | | |
|---|---|---|---|---|
| 4,060,310 | A | 11/1977 | Brown | |
| 4,516,618 | A | 5/1985 | Gardner et al. | |
| 5,353,152 | A | 10/1994 | Realmuto | |
| 5,475,949 | A | 12/1995 | McCoy | |
| D385,363 | S | 10/1997 | S.o slashed.lbeck | |
| D432,667 | S | 10/2000 | M.o slashed.ller | |
| 6,250,728 | B1 | 6/2001 | Thorp | |
| 6,283,427 | B1 | 9/2001 | M.o slashed.ller et al. | |
| D527,813 | S | 9/2006 | Dodge et al. | |
| D531,884 | S | 11/2006 | Fabrizi | |
| D582,055 | S | 12/2008 | Moller et al. | |
| 7,740,047 | B2 | 6/2010 | Koop et al. | |
| D669,771 | S | 10/2012 | Geiger | |
| 8,316,914 | B2 * | 11/2012 | Bell | E05D 15/0652 16/95 R |
| D677,819 | S | 3/2013 | Mayfield et al. | |
| 8,807,192 | B2 | 8/2014 | Marocco | |
| D712,727 | S | 9/2014 | Geiger | |
| 9,644,422 | B2 * | 5/2017 | Marocco | E06B 9/42 |
| 2005/0183835 | A1 | 8/2005 | Nien | |
| 2005/0270644 | A1 | 12/2005 | Devos et al. | |
| 2008/0048537 | A1 | 2/2008 | Chang | |
| 2008/0289264 | A1 | 11/2008 | Bowman | |
| 2011/0139382 | A1 | 6/2011 | Daniels | |
| 2012/0075697 | A1 | 3/2012 | Astill | |
| 2012/0268815 | A1 | 10/2012 | Hendricks | |
| 2012/0273140 | A1 | 11/2012 | Morales | |
| 2013/0235455 | A1 | 9/2013 | Qingjun et al. | |
| 2014/0133019 | A1 | 5/2014 | Mullet et al. | |
| 2015/0136941 | A1 | 5/2015 | Geiger | |

OTHER PUBLICATIONS

U.S. Appl. No. 29/512,038, filed Dec. 16, 2014, Geiger.
International Search Report and Written Opinion regarding PCT/US2013/041175, dated Sep. 12, 2013, 9 pages.

* cited by examiner

RECESSED SHADE AND CURTAIN STORAGE AND DEPLOYMENT SYSTEM

CROSS-REFERENCE TO RELATED APPLICATIONS

This application is a continuation-in-part of U.S. patent application Ser. No. 14/970,117, filed on Dec. 15, 2015, which claims priority to and the benefit of U.S. Provisional Patent Application No. 62/092,488, filed on Dec. 16, 2014, each of which are incorporated herein by reference in their entireties and for all purposes.

BACKGROUND

To hide brackets and rollers of window shades from plain sight, contractors may install the brackets and rollers into a ceiling recess, removing them from plain sight. Such recesses typically have an opening through which a contractor may install and access a roller shade. The opening is typically covered such that the material of the cover abuts a material covering the ceiling base and a slit is left in the middle of the material covering the opening. The slit may allow a shade to be deployed into the room use to cover a window and allow the shade to be retracted from the room for storage. However, these current systems for storing and deploying roller shades typically create a visually unpleasing juncture at the interface of the material covering the ceiling base and the material covering the opening of the recess.

Similarly, when mounting curtains to a ceiling, a track can be used to support hangers connected to the curtain. However, certain tracks often include flanges that are flush with or overlap the material covering the ceiling base, such that the track is visible to a person viewing the covering and track. In some instances, a track is fully inset into a pocket in the ceiling. In some instances, openings in a ceiling used to house such tracks are wider than the respective track to facilitate installation, leaving a relatively large opening that is clearly visible whenever the curtain is drawn back in a stowed position. Such arrangements create visually unpleasing breaks in the exposed surface of the ceiling.

SUMMARY

An exemplary embodiment relates to a shade and curtain storage and deployment system including a shade assembly disposed at least partially within a recess formed in a ceiling, a curtain assembly disposed at least partially within the recess, and an access panel disposed within the recess such that a visible surface of the access panel occupies substantially the same plane as a visible surface of the ceiling surrounding the recess. The shade assembly includes a shade movable between a retracted position and an extended position. The curtain assembly includes a curtain movable between a fully retracted position and a fully extended position and a track having a plurality of hangers configured to translate on the track and support the curtain. A first gap is provided between a first edge of the access panel and the ceiling, and a second gap is provided between a second edge of the access panel and the ceiling. The first gap is configured to enable the shade to extend through the first gap from the recess to an area below the ceiling when the shade is in the extended position. The second gap is configured to enable the curtain to extend along the second edge between the fully retracted position and the fully extended position to at least partially obscure the shade. The track extends along the second edge and is disposed entirely above the plane occupied by the visible surface of the access panel.

Another exemplary embodiment relates to a shade and hanging cover storage and deployment system including a hanging cover assembly disposed at least partially within a recess formed in a ceiling, a shade assembly including a shade movable between a retracted position and an extended position, and an access panel disposed within the recess such that a visible surface of the access panel occupies substantially the same plane as a visible surface of the ceiling surrounding the recess. The hanging cover assembly includes a hanging cover movable between a fully retracted position and a fully extended position and a track having a plurality of hangers configured to translate on the track and support the hanging cover. The hanging cover is configured to block light emanating from a window when in the fully extended position. The shade is configured to block light emanating from the window when moved into the extended position. A gap is provided between an edge of the access panel and the ceiling. The gap is configured to enable the hanging cover to extend along the edge between the fully retracted position and the fully extended position. The access panel is selectively coupled to a support and configured to be decoupled from the support when a substantially vertical force is applied to the access panel. The track extends along the edge and is disposed entirely above the plane occupied by the visible surface of the access panel. A portion of the access panel extends directly beneath the track.

Another exemplary embodiment relates to a shade and hanging cover storage and deployment system including a shade assembly disposed at least partially within a first area of a volume defined within a ceiling, a hanging cover assembly disposed at least partially within a second area of the volume, and an access panel coupled to the ceiling and extending along a side of the volume. The shade assembly includes a shade movable between a retracted position and an extended position. The hanging cover assembly includes a hanging cover movable between a fully retracted position and a fully extended position and a track having a plurality of hangers configured to translate on the track and support the hanging cover. A first gap is provided between a first edge of the access panel and the ceiling, and a second gap is provided between a second edge of the access panel and the ceiling. The first gap is configured to enable the shade to extend through the first gap from the volume to an area below the ceiling when the shade is in the extended position. The second gap is configured to enable the hanging cover to extend along the second edge between the fully retracted position and the fully extended position to at least partially obscure the shade. The first and second areas of the volume are fluidly coupled within the ceiling such that the volume contains the hanging cover assembly and the shade assembly.

DETAILED DESCRIPTION

Figure 1A:
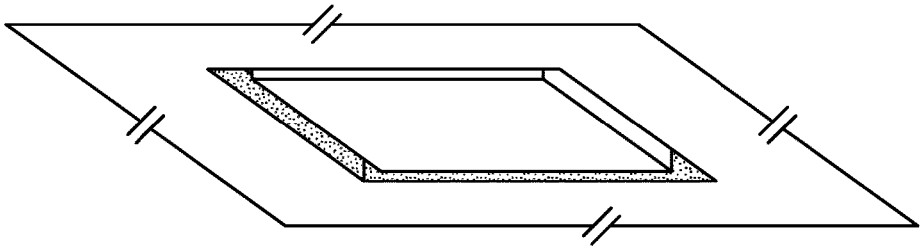
FIG. 1A-1C are perspective views of an example shade storage and deployment system according to an implementation described herein.

FIGS. 1A-10C are attached thereto and incorporated herein by this reference. The following detailed description refers to the accompanying FIGS. 1A-8. The same reference numbers in different figures may identify the same or similar elements.

The systems, methods, apparatuses, devices, technologies, and/or techniques (hereinafter referred to as the "system"), described herein, may enable a visually pleasing juncture to be created between a material covering a recess, in which mounts and shades are installed, and a material covering a ceiling base.

The system may include one or more mount that is configured to be secured to a member of a structure (e.g., joist, beam, ceiling beam, ceiling joist, roof truss, wall stud, top, bottom, or side wall of a recess, floor joist, any other joist, beam, or stud etc.). The one or more mount may be configured to support one or more tube (e.g., a roller shade tube). The one or more tube may be rotatably attached to the mount and the one or more tube may include one or more shade. The one or more tube and/or mount may be configured to be in wired or wireless communication with a control mechanism to enable rotation of the tube. The one or more shade and the one or more tube may be configured such that a free end of the shade is moved away from and/or towards the one or more tube during rotation of the tube and/or shade.

Additionally, or alternatively, the system may include one or more attachment mechanism configured to be attached to a member of a structure (e.g., joist, beam, ceiling beam, ceiling joist, roof truss, wall stud, top, bottom, or side wall of a recess, floor joist, any other joist, beam, or stud etc.). The one or more attachment mechanism may include one or more fastener that is configured to enable another component, such as a spacer, to be removably attached to the attachment mechanism.

The system may, also or alternatively, include the spacer that enables one or more gap to be created between a ceiling covering and the spacer. The one or more gap may be configured to enable the one or more shade to be deployed and/or retracted through the one or more gap. The spacer may include a corresponding fastener that is configured to enable the spacer to be removably attached to the fastener of the attachment mechanism. The fastener and/or corresponding fastener may enable the spacer to move laterally and/or vertically within the opening. The spacer may also, or alternatively, include a spacer covering, which may include the same and/or visually similar material to the material of the ceiling covering. Additionally, or alternatively, the spacer may include a deflector that is configured to deflect the shade through one or more gap between the spacer and the ceiling covering. The spacer may include electrical, electronic, or other components (e.g., light source, camera, speaker, microphone, smoke detector, etc.). The one or more gap may prevent the formation of a visually unpleasing juncture. Additionally, or alternatively, the spacer may be oriented such that only the one or more gap used for the retraction and deployment of the one or more shade are created.

The system is described in the context of storing and/or deploying one or more shade from a ceiling. However, in other implementations, the system need not be so limited. For example, the system may be configured to store and/or deploy one or more shade in and/or from any portion of a structure (e.g., floor, wall, window frame, window ledge, counter, outdoor structures, etc.).

Additionally or alternatively, the system is described in the context of storing and/or deploying one or more roller shade. However, in other implementations, the system need not be so limited. For example, the system may also, or alternatively, be configured to store and deploy one or more screen, canvas, and/or other material for a variety of purposes (e.g., temporary flexible barriers, temporary screens, display art work, etc.). Additionally, or alternatively, the system may be configured to enable the storage and/or deployment of other types of shades (e.g., accordion, honeycomb shades, etc.).

Figure 1B:
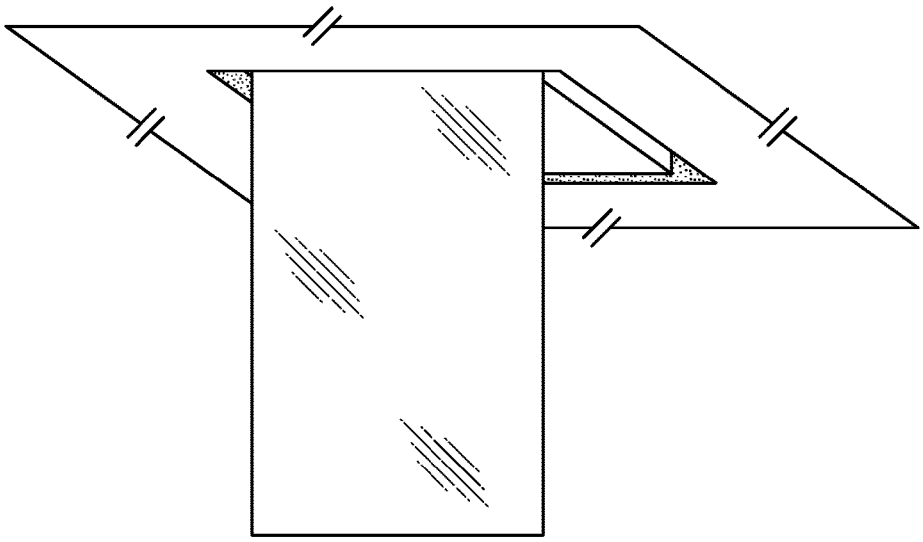
Figure 1C:
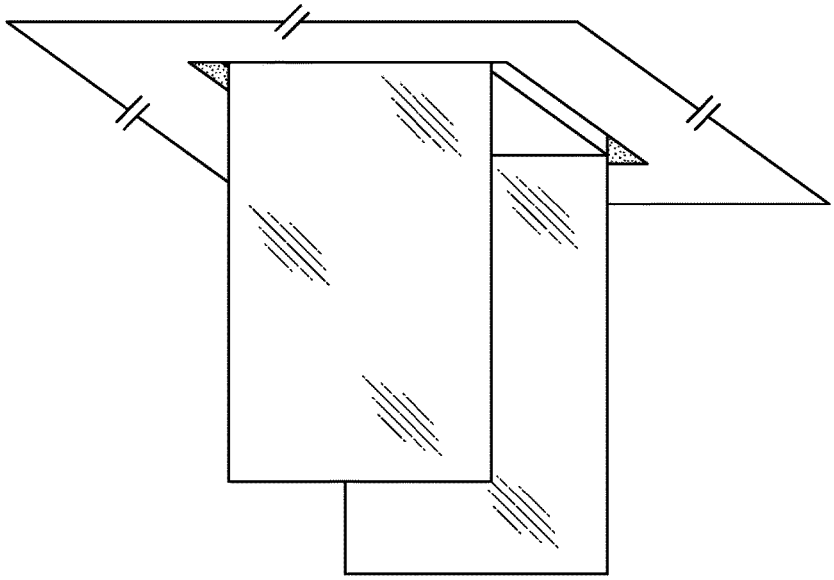

FIG. 1A-1C are perspective views of an example shade storage and deployment system according to an implementation described herein. As described in further detail below, the system may include a spacer that is configured to enable the creation of one or more gap between the spacer and a material covering the ceiling base. The one or more gap may allow one (e.g., FIG. 1B) or more (e.g., FIG. 1C) shade to be retracted and/or deployed for use.

Figure 1D:
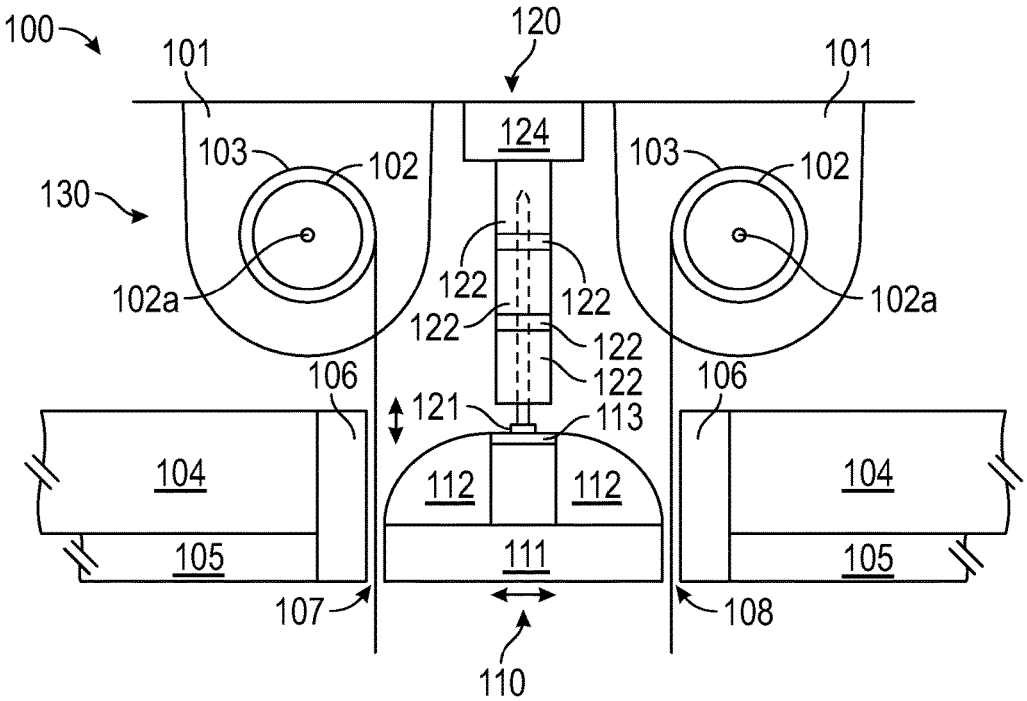
FIG. 1D is a diagram of the example shade storage and deployment system of FIGS. 1A-1C including more than one shade according to an implementation described herein.

FIG. 1D is a diagram of an example shade storage and deployment system 100 (hereinafter, "system 100") of FIGS. 1A-1C including more than one shade according to an implementation described herein. As shown in FIG. 1D, system 100 may include one or more mount 101 (hereinafter, "mount 100"), one or more rotatable tube 102 (hereinafter, "tube 102"), a spacer 110, and one or more attachment mechanism 120 (hereinafter, "attachment mechanism 120"). The number of components, illustrated in FIG. 1D (and/or FIGS. 1A-8), is provided for explanatory purposes only and is not intended to be so limited. There may be additional components, fewer components, different components, or differently arranged components than illustrated in FIG. 1D. Also, in some implementations, one or more of the components of system 100 may perform one or more functions described as being performed by another one or more of the components of system 100.

Mount 101 may be formed by a material of sufficient rigidity and strength to support the weight of tube 102, shade 103 and/or any static and/or dynamic loads (e.g., forces, torques, tensions, compressions, etc.) imparted on mount 101 by tube 102, shade 103, by one or more of components 102-124 and/or any additional components (e.g., control mechanism described below). Mount 101 may, for example, be made of metal, plastic, Teflon®, acrylic, urethane, wood, fiberglass, composite, etc., or some combination thereof. The strength and/or rigidity of the material may enable mount 101 to maintain a basic shape when being used and/or to enable various components to be attached to mount 101 and to be used.

Tube 102 may be formed by a material of sufficient rigidity and strength to support the weight of shade 103 and/or any static and/or dynamic loads (e.g., forces, torques, tensions, compressions, etc.) imparted on tube 102 by mount 101, shade 103, by one or more of components 102-124, and/or any additional components (e.g., control mechanism). Tube 102 may, for example, be made of metal, plastic, Teflon®, acrylic, urethane, wood, fiberglass, composite, etc. or some combination thereof. The strength and/or rigidity of the material may enable tube 102 to maintain a basic shape when being used, attached to mount 101 and/or any other component, and/or to enable various components to be attached to tube 102 and to be used.

The figures and description herein identify mount 101 as being disk-shaped and/or tube 102 as being generally circular in shape for explanatory purposes. Additionally, or alternatively, in other implementations, the shape need not be so limited. For example, mount 101 and/or tube 102 may be of any shape, such as circular, elliptical, triangular, square, pentangular, hexangular, octangular, etc.

Spacer 110 may include a spacer covering 111, one or more deflector 112 (hereinafter, "deflector 112"), and a corresponding fastener 113 (described in further detail below). Spacer covering 111 may be formed by a material of sufficient rigidity and strength to support the weight of deflector 112, corresponding fastener 113, and/or any other component of spacer 110, and/or any static and/or dynamic loads (e.g., forces, torques, tensions, compressions, etc.) imparted on spacer covering 111 by deflector 112, corresponding fastener 113, and/or by one or more of components 102-124 (and/or any additional components). Spacer covering 111 may, for example, be made of plaster, metal, plastic, Teflon, acrylic, urethane, wood, fiberglass, composite, etc. or some combination thereof. Spacer covering 111 may be made of a material that is the same as the material of horizontal covering 105 and/or vertical covering 106 (described in further detail below) (e.g., sheet rock, plaster, title, wood, metal, ceramic, etc.) or is made of a material that appears visually similar to the material of horizontal covering 105 and/or vertical covering 106 (e.g., medium density fiber ("MDF"), other fiberboard, etc.). The strength and/or rigidity of the material may enable spacer covering 111 to maintain a basic shape when being used, when being attached to and/or while attached to deflector 112 and/or any other component, and/or to enable various components to be attached to spacer covering 111 and to be used.

The figures and description herein identify spacer 110 and/or spacer covering 111 as being generally rectangular shape for explanatory purposes. Additionally, or alternatively, in other implementations, the shape need not be so limited. For example, spacer 110 and/or spacer covering 111 may be of any shape, such as circular, elliptical, triangular, square, pentangular, hexangular, octangular, etc. Additionally, or alternatively, spacer 110 and/or spacer covering 111 may include a flat shape, a convex shape, concave shape, or combination thereof such that spacer covering 111 may match the contour of horizontal covering 105 and/or vertical covering 106.

Deflector 112 may be formed by a material of sufficient rigidity and strength to support the weight of spacer covering 111, corresponding fastener 113, and/or any other components of spacer 110, and/or any static and/or dynamic loads (e.g., forces, torques, tensions, compressions, etc.) imparted on deflector 112 by spacer covering 111, corresponding fastener 113, and/or by one or more of components 102-124 (and/or any additional components). Deflector 112 may, for example, be made of metal, plastic, Teflon®, acrylic, urethane, wood, fiberglass, composite, plaster, sheet rock, etc., or some combination thereof. The strength and/or rigidity of the material may enable deflector 112 to maintain a basic shape when being used, when being attached to and/or while attached to spacer covering 111 and/or corresponding fastener 113, and/or any other component, and/or to enable various components to be attached to deflector 112 and to be used.

Additionally, or alternatively, deflector 112 may be configured to deflect a free end of shade 103 through gaps 107 and/or 108 (described in further detail below). For example, deflector 112 may include any shape that enables smooth or continuous deflection of shade 103 through gaps 107 and 108, e.g., such as a curved shape (as shown in FIGS. 1D-5 and 8), to enable the deflection of shade 103 while minimizing the risk of tearing and/or otherwise damaging shade 103. The shape of deflector 112 is not intended to be so limited.

The number of components of spacer 110, illustrated in the figures, is provided for explanatory purposes only and is not intended to be so limited. There may be additional components, fewer components, different components, or differently arranged components than illustrated in the figures. Also, in some implementations, one or more of the components of spacer 110 may perform one or more functions described as being performed by another one or more of the components of spacer 110. For example, the figures and description herein identify spacer 110 as including spacer covering 111 and deflector 112 as separate components, for explanatory purposes. Additionally, or alternatively, in other implementations, spacer 110 need not be so limited. In a non-limiting implementation, spacer covering 110 and deflector 112 may be formed as one component that includes one or more materials and/or one or more shape.

Attachment mechanism 120 may include one or more support 124 (hereinafter, "support 124"), one or more insert 122 (hereinafter, "insert 122"), and one or more fastener 121 (hereinafter, "fastener 121"). Support 124 may be formed by a material of sufficient rigidity and strength to support insert 122, fastener 121 (described in further detail below), spacer 110, and/or any other components of attachment mechanism 120 and/or spacer 110, and/or any static and/or dynamic loads (e.g., forces, torques, tensions, compressions, etc.) imparted on support 124 by insert 122, fastener 121, spacer 110, and/or by one or more of components 102-124 (and/or any additional components). Support 124 may, for example, be made of metal, plastic, Teflon®, acrylic, urethane, wood, fiberglass, composite, plaster, sheet rock, etc., or some combination thereof. The strength and/or rigidity of the material may enable support 124 to maintain a basic shape when being used, when being attached to and/or while attached to a structural support (e.g., beam, pillar, frame, wall, floor, etc.), insert 122, fastener 121, and/or any other component, and/or to enable various components to be attached to support 124 and to be used.

Insert 122 may be formed by a material of sufficient rigidity and strength to support fastener 121, corresponding fastener 113, spacer 110, and/or any other components of attachment mechanism 120 and/or spacer 110, and/or any static and/or dynamic loads (e.g., forces, torques, tensions, compressions, etc.) imparted on insert 122 by support 124, fastener 121, corresponding fastener 113, spacer 110, and/or by one or more of components 102-124 (and/or any additional components). Insert 122 may, for example, be made of metal, plastic, Teflon®, acrylic, urethane, wood, fiberglass, composite, plaster, sheet rock, foam, etc., or some combination thereof. The strength and/or rigidity of the material may enable insert 122 to maintain a basic shape when being used, when being attached to and/or while attached to support 124, fastener 121, and/or any other component, and/or to enable various components to be attached to insert 122 and to be used.

Figure 3:
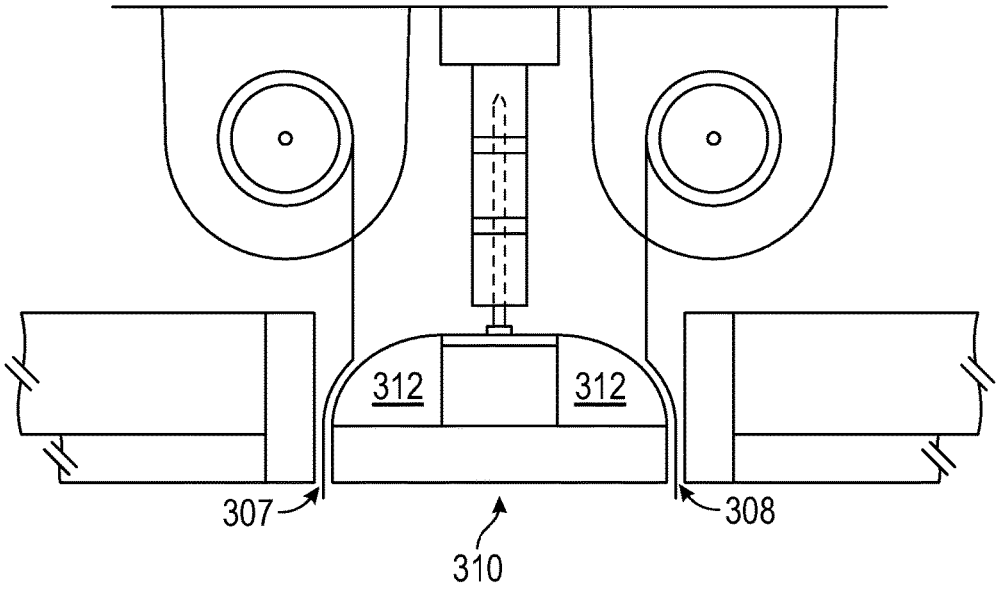
FIG. 3 is a diagram of an example shade storage and deployment system that includes a different spacer component than that shown in FIG. 1D and according to an implementation described herein.
Figure 4:
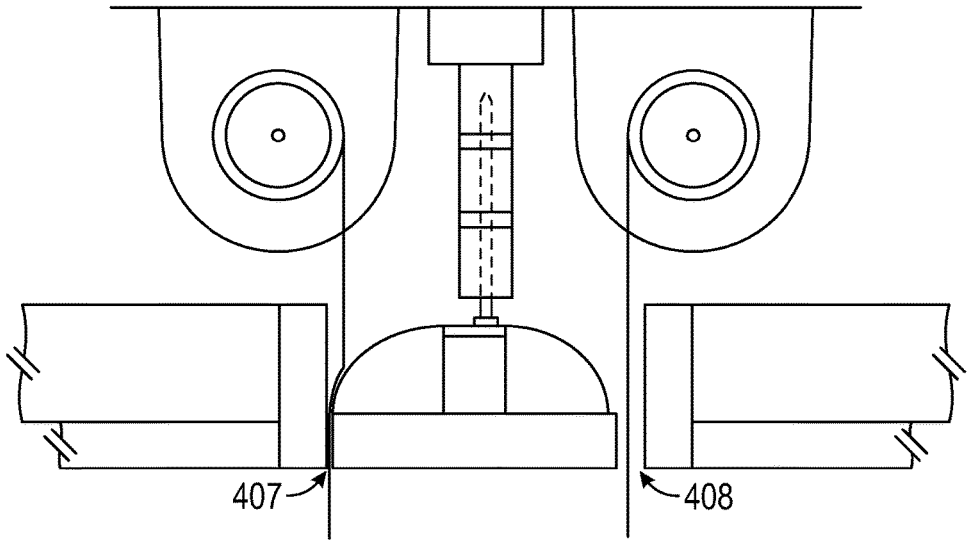
FIG. 4 is a diagram of an example shade storage and deployment system that includes a spacer component in a different position than that shown in FIG. 1D and according to an implementation described herein.
Figures 5A, 5B, 5C, 5D:
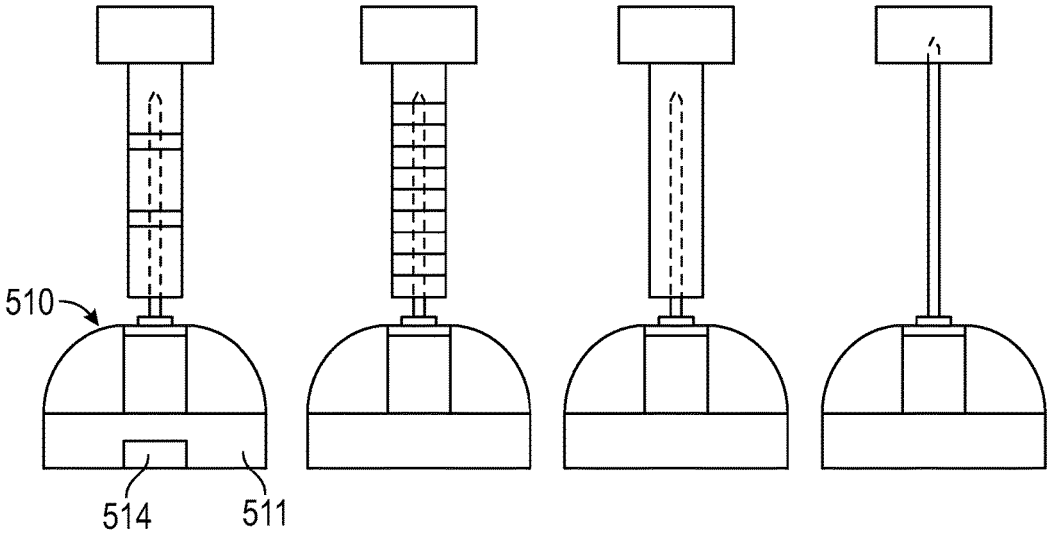
FIGS. 5A-5D are diagrams of example attachment mechanisms and spacer components of an example shade storage and deployment system according to an implementation described herein.

The figures and description herein identify support 124 and insert 122 as being generally rectangular shape for explanatory purposes. Additionally, or alternatively, in other implementations, the shape need not be so limited. For example, support 124 and/or insert 122 may be of any shape, such as circular, elliptical, triangular, square, pentangular, hexangular, octangular, etc. Additionally, or alternatively, while FIGS. 1D-5A illustrate the attachment mechanism as including five inserts (e.g., FIG. 5A), in other implementations, the attachment mechanism need not be so limited. For example, in a non-limiting implementation, the attachment mechanism may include more or less than five inserts (e.g., as shown in FIG. 5B-5C) or may not include any insert (e.g., as shown in FIG. 5D).

As shown in FIG. 1D, system 100 may be configured to be installed into recess 130, which may be formed, for example, within a ceiling, wall, floor, or other structural element. Mount 101 may be configured to be temporarily and/or permanently secured to a member of a structure (e.g., joist, beam, ceiling beam, ceiling joist, roof truss, wall stud, top, bottom, or side wall of a recess, floor joist, any other joist, beam, or stud etc.) and/or any other portion of a structure sufficient to support the weight and/or forces of mount 101, tube 102, and/or any additional component. For example, mount 101 may include one or more aperture that is configured to receive a screw and/or other appropriate fastening means. Mount 101 may be configured to support tube 102 and enable tube 102 to be rotatably attached to mount 101. For example, system 100 may include two mounts 101 per tube, i.e., one mount for each end of tube 102. Additionally, or alternatively, mount 101 may have one or more opening (not shown) that is configured to receive one end of (or a portion of one end of) tube 102, and/or tube 102 may interlock with the one or more opening. Additionally, or alternatively, the one or more opening may include a bearing that is configured to allow tube 102 to rotate freely about tube rotational axis 102*a*, minimizing friction and wear.

Figure 8:
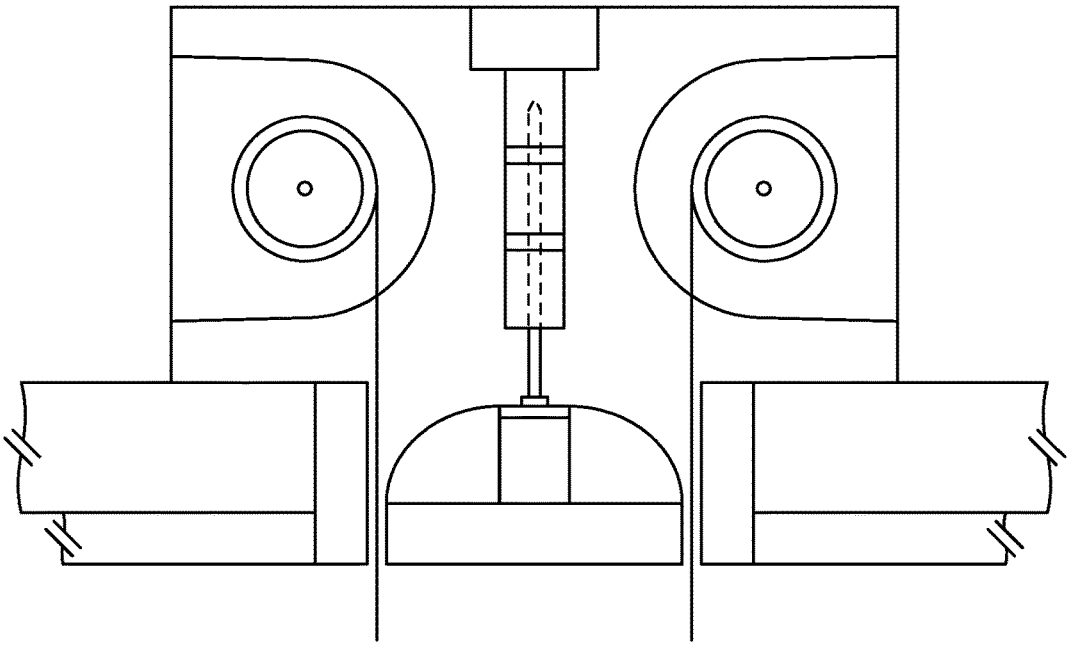
FIG. 8 is a diagram of an example shade storage and deployment system of FIGS. 1A-D that includes a mount component in a different position than that shown in FIG. 1D and according to an implementation described herein.
Figure 9A:
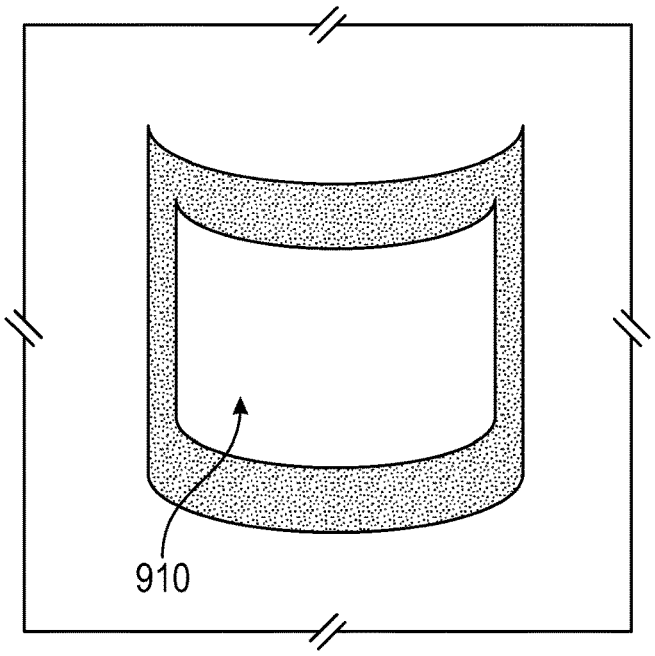
FIGS. 9A-C are bottom elevational views of an example shade storage and deployment system according to an implementation described herein.
Figure 9B:
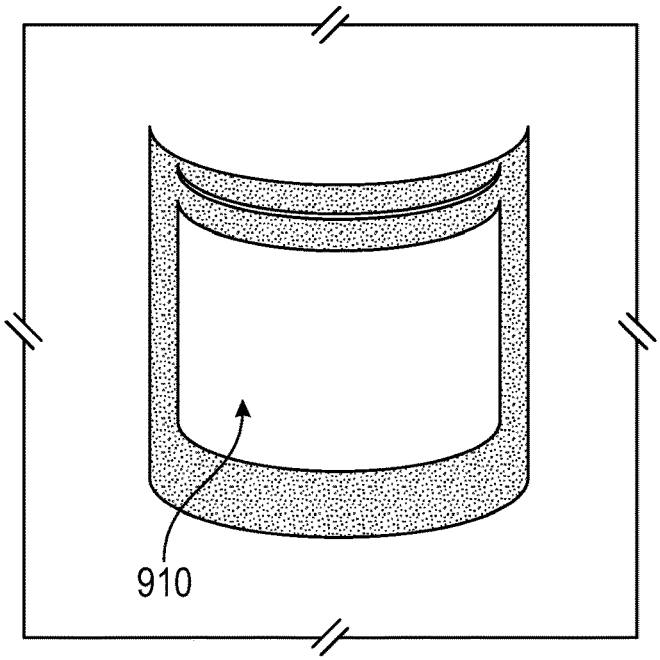
Figure 9C:
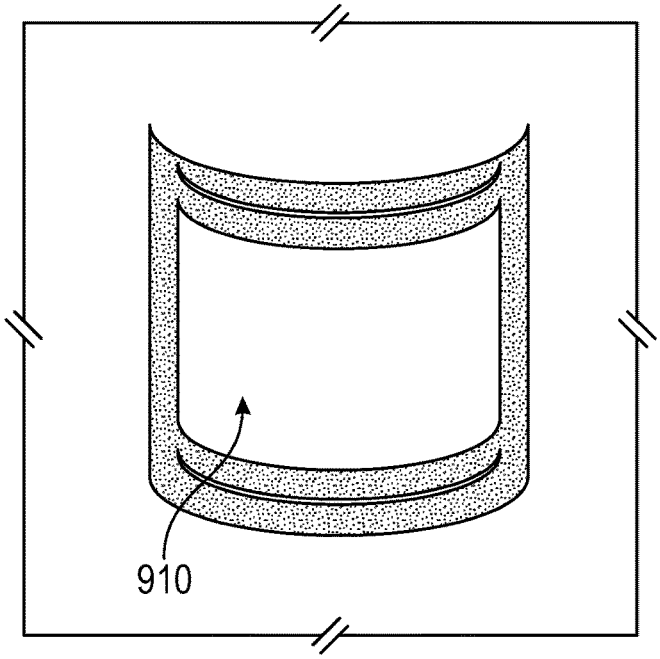
Figure 10A:
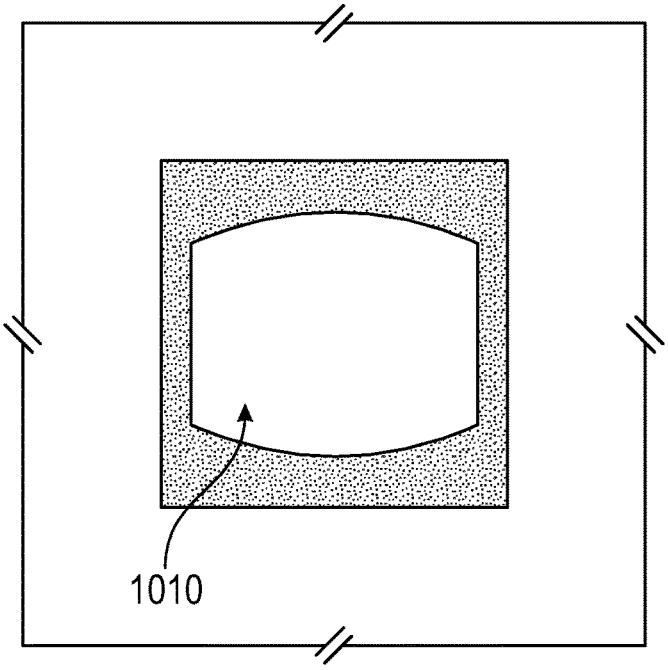
FIGS. 10A-C are diagrams of example shade storage and deployment systems that include different spacer components than that shown in FIGS. 6A-C and according to an implementation described herein.
Figure 10B:
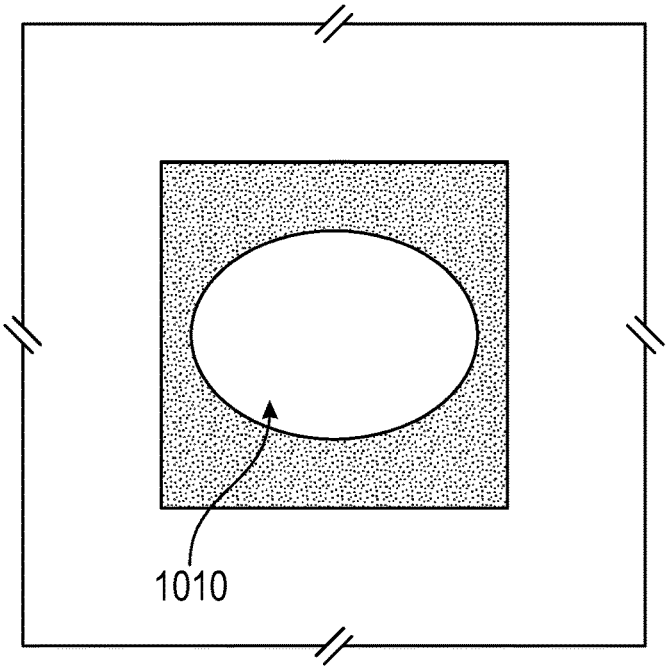
Figure 10C:
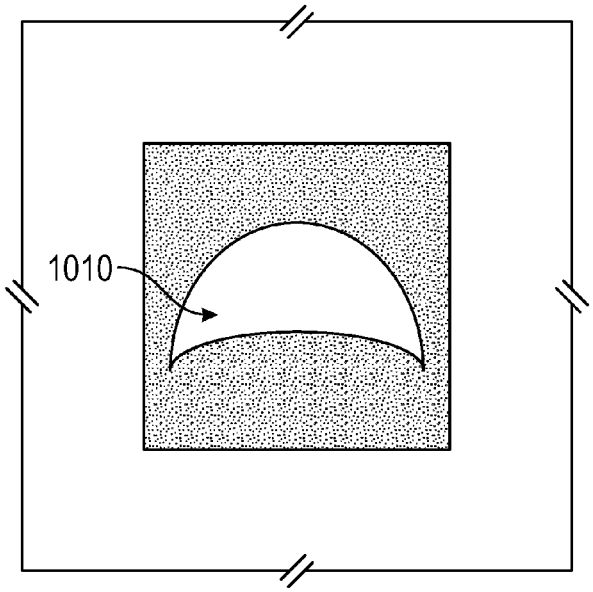
Figure 11:
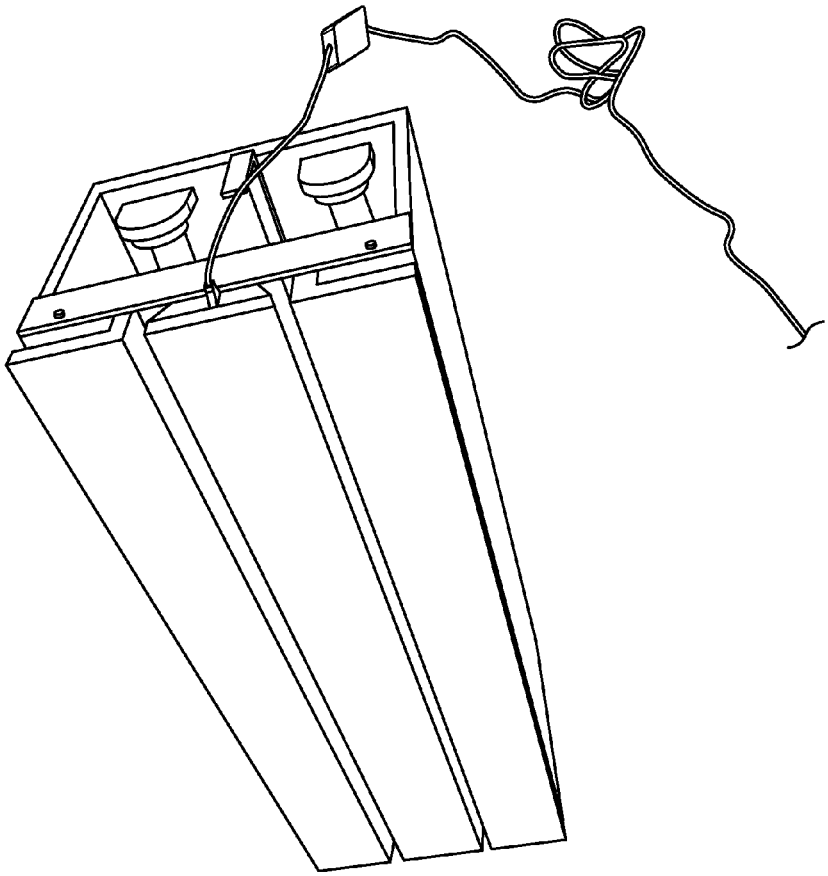
FIG. 11 is a bottom perspective view of an example assembly of a shade storage and deployment system according to an implementation described herein.

In other implementations, mount 101 need not be so limited. Mount 101 may be configured to enable tube 102 to rotatably attach to mount 101 by any suitable means generally known in the art. Additionally, or alternatively, mount 101 may be configured such that one mount is sufficient to support tube 102 and allow tube 102 to rotatably attach to mount 101. Additionally, or alternatively, mount 101 may include a multiple mounting mechanism such that one mount may be configured to support two or more tubes and enable the two or more tubes to be rotatably attached to mount 101. Additionally or alternatively, the orientation of mount 101 shown in FIG. 1D is not intended to be limiting. FIG. 8 a diagram of an example shade storage and deployment system of FIGS. 1A-D that includes a mount component in a different position that shown in FIG. 1D and according to an implementation described herein. Mount 101 may be configured to be securely attached to a structural member in any orientation that enables mount 101 to support tube 102 and/or shade 103 (e.g., as shown in FIG. 8).

Tube 102 may be configured to be removably and rotatably attached to mount 101, such that tube 102 may rotate about tube rotational axis 102*a*. For example, tube 102 may include a mechanism (e.g., key, pin, groove, slot, tab, etc.) that may interlock with a bearing of mount 101. Additionally, or alternatively, tube 102 may itself include a pivotable mechanism configured to enable tube 102 to rotate about 102*a*. In other implementations, tube 102 need not be so limited. Tube 102 may be configured to enable tube 102 to rotate by any suitable means generally known in the art.

Mount 101 and/or tube 102 may be configured to connect to a control mechanism (e.g., motor, servo, air compressor, hydraulic, pneumatic, and/or some other mechanical control system) that is configured to provide a force (e.g., torque on a pin or bearing) to mount 101 and/or tube 102 to cause at least tube 102 to rotate. The control mechanism may be configured to be in wired and/or wireless communication with a user device (e.g., input device, keypad, PDA, phone, laptop, computer, remote control, etc.), sensor (e.g., motion, temperature, pressure, position, etc.), and/or other device (e.g., timer, measurement device, light switch, door, window, television, etc.). The user device, sensor, and/or other device may be configured to send a signal to the control mechanism to automatically rotate (e.g., counter-clockwise, clockwise) tube 102 about tube rotational axis 102*a* and/or at least a portion of mount 101.

Figure 2:
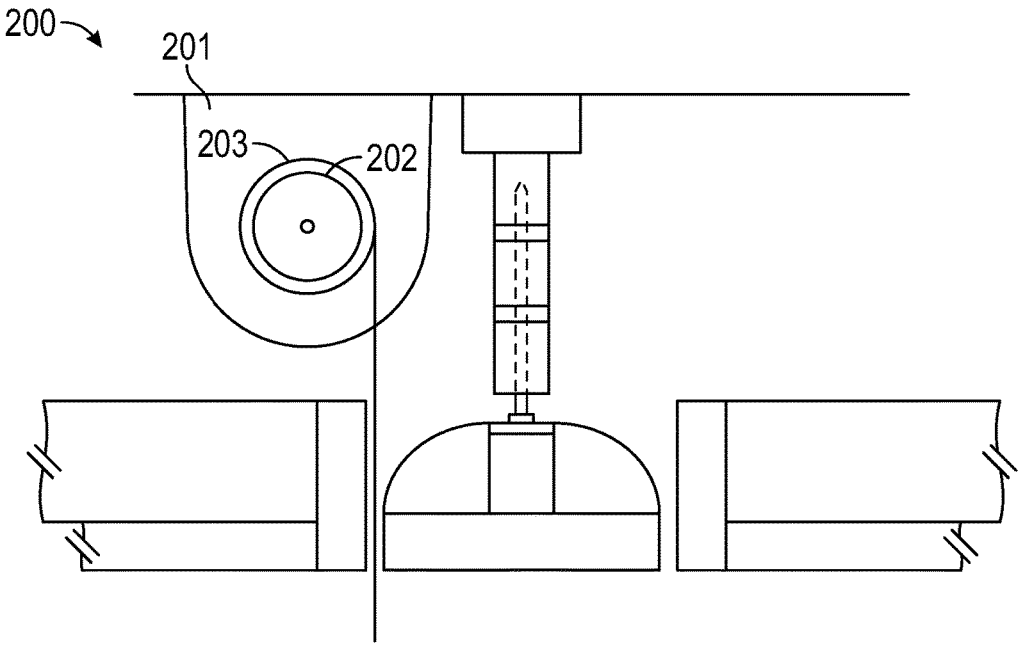
FIG. 2 is a diagram of an example shade storage and deployment system including one shade according to an implementation described herein.

One or more shade 103 (hereinafter, "shade 103") may be disposed on and/or wound around tube 102 by any known technique in the art, such that rotation of tube 102 may enable a free end of shade 103 to move away from and/or towards tube 102, and/or to be deployed and/or retracted through gaps 107 and/or 108. Shade 103 may be made of any material known in the art of suitable properties (e.g., strength, density, transparency, opaqueness, etc.) and may also, or alternatively, be made of a pliable and/or flexible material that is suitable to be controlled (e.g., bent, conformed, curved, deformed, etc.) upon contact with spacer 110, such that shade 103 may conform to a same or similar shape of spacer 110 when brought into contact with spacer 110 ("shaped controlled") (as further described below). FIG. 1D and the description herein identify system 100 as including two tubes 102 and two shades 103. Additionally, or alternatively, in other implementations, the number of tubes and shades need not be so limited. For example, FIG. 2 is a diagram of an example shade storage and deployment system 200, which may include only one tube 202 and/or shade 203.

Returning to FIG. 1D, attachment mechanism 120 may be configured to be temporarily and/or permanently secured to a member of a structure (e.g., joist, beam, ceiling beam, ceiling joist, roof truss, wall stud, top, bottom, or side wall of a recess, floor joist, any other joist, beam, or stud etc.) and/or any other portion of a structure sufficient to support the weight of attachment mechanism 120, spacer 110, and/or any additional component. Attachment mechanism 120 may include support 124, which may be temporarily or permanently secured (e.g., via screw, nail, glued, Velcro®, epoxy, etc.) to a member of a structure. Attachment mechanism 120 may, also or alternatively, include fastener 121, which may be directly attached to support 124 (e.g., via threaded engagement, etc.) (as shown in FIG. 5D). Additionally, or alternatively, fastener 121 may be attached to insert 122 (e.g., wooden insert, polymer insert, metal insert, nuts, bolts, etc.) and insert 122 may be attached to support 124 (e.g., via screw, nail, glued, Velcro, epoxy, etc.). Insert 122 may be configured to provide additional support and/or rigidity to fastener 121. Additionally or alternatively, fastener 121 may be configured to be adjustable in length by any normal methods known in the art (e.g., via adjustment of threaded engagement, telescopic adjustment mechanism, etc.). The number of inserts 122 attached to fastener 121 may depend on, for example, the length of fastener 121.

Spacer 110 may include corresponding fastener 113, which may be configured to enable spacer 110 to be removably attached to fastener 121. Fastener 121 and corresponding fastener 113 may include, for example, attracting magnets with magnetic force that is strong enough to overcome gravitational force and securely attach spacer 110 to fastener 122 without spacer 110 falling, yet weak enough to enable removal of spacer 110. In other implementations, the type of fastener 121 and corresponding fastener 113 need not be so limited. For example, fastener 121 and corresponding fastener 113 may include any fastening mechanism sufficient to secure spacer 110 to fastener 121 (e.g., key and slot, button, male-female connection, groove and tongue, tab and slot, Velcro®, etc.).

The shapes and sizes of fastener 121 and corresponding fastener 113 shown in the figures and described herein are not intended to be limiting. Additionally or alternatively, in other implementations, fastener 121 and corresponding fastener 113 may be of any shape, dimensions, and/or size suitable to enable removable attachment of spacer 110 and attachment mechanism 120. For example, the width of corresponding fastener 113 and/or fastener 121 may be as wide as (or nearly as wide as) spacer 110 or a portion of spacer 110 to enable further lateral movement of spacer 110 within a partial opening of recess 130.

As shown in FIG. 1D, an opening of recess 130 may be partially covered by ceiling base 104 (e.g., joist, beam, truss, etc.), leaving a partial opening of recess 130. Additionally, or alternatively, ceiling base 104 may include horizontal covering 105 and vertical covering 106 (e.g., made of plaster, wood, sheet rock, ceramic, metal, or a combination thereof, etc.) to effectively prohibit ceiling base 104 from being visual in plain view. The number, shape, size, and/or orientation of ceiling coverings 105 and/or 106 shown in the figures and described herein are not intended to be limited. Additionally, or alternatively, ceiling coverings may include any number, shape, size, and/or orientation necessary to effectively prohibit the ceiling base from being visual in plain view.

Spacer 110 may be oriented into the partial opening of recess 130 such that two gaps 107 and 108 exist between spacer 110 and vertical covering 106 (and/or horizontal cover 106). Gaps 107 and 108 may prevent the abutment of spacer 110 with vertical covering 106 and/or horizontal covering 105, and effectively eliminate a visually unpleasing juncture. This may increase the aesthetic value of the structure, and/or the monetary value of the structure. Additionally, or alternatively, spacer 110 may be oriented to allow one or more shade 103 to be deployed and/or retracted through gaps 107 and 108, without deflection from deflector 112, as shown for example in FIG. 1D.

Additionally, or alternatively, the spacer may be adjusted in size to decrease and/or increase the size of the gaps through which a shade is deployed and/or retracted. FIG. 3 is a diagram of an example shade storage and deployment system that includes a different spacer component than that shown in FIG. 1D and according to an implementation described herein. For example, as shown in FIG. 3, spacer 310 may be oriented in the partial opening of recess 130 (e.g., via removal of spacer 110 and replacement with 310). Spacer 310 may be wider than spacer 110 enabling the gaps 307 and 308 to be smaller than gaps 107 and/or 108. Additionally, or alternatively, if spacer 310 impedes the direct path of shade 103 to gaps 307 and/or 308, deflector 312 may deflect shade 103 through gaps 307 and/or 308. Shade 103 may be made of any material known in the art of suitable properties (e.g., strength, density, transparency, opaqueness, etc.) and may also, or alternatively, be made of a pliable and/or flexible material that is suitable to be controlled (e.g., bent, conformed, curved, deformed, etc.) upon contact with spacer 310. For example, shade 103 may conform to a same or similar shape of spacer 310 when brought into contact with spacer 310 ("shaped controlled"). The controlling of a shape (e.g., bending, conforming, curving, deforming, etc.) of a shade via contact with a spacer is further described below with reference to FIGS. 9A-C and FIGS. 10A-C.

Additionally, or alternatively, the position of spacer 110 may be adjusted horizontally. FIG. 4 is a diagram of an example shade storage and deployment system that includes a spacer component in a different position that than shown in FIG. 1D and according to an implementation described herein. As shown in FIG. 4, fastener 121 and corresponding fastener 113 may enable horizontal movement of spacer 110, such that gaps 407 and 408 may be of different sizes relative to one another. Additionally, or alternatively, shade 103 may be deflected by deflector 112 through gap 407 if spacer 110 impedes the direct path of the free end of shade 103 through gap 407.

Additionally or alternatively, the position of spacer 110 may be adjusted vertically. For example, in one non-limiting implementation, adjustment of the length of fastener 122 may enable vertical adjustment of spacer 110, such that the outermost surface of spacer covering 111 may align with the outermost surface of horizontal covering 105. In another implementation, spacer 110 may be configured to be adjusted vertically by other mechanisms, e.g., via adjustment of corresponding fastener 113.

Additionally, or alternatively, the spacer may be configured to include electrical, electronic, and/or other elements. FIG. 5A is a diagram of an example attachment mechanism and spacer component of an example shade storage and deployment system according to an implementation described herein. For example, as shown in FIG. 5A, spacer 510 may include lighting element 514 (e.g., LED, halogen, fluorescent, neon, etc.). Lighting element 514 may be configured to be adjustable (e.g., via ball and socket connection, etc.) such that light emitted from lighting element 514 may be directed in a desired direction. Additionally or alternatively, lighting element 514 may be installed on the surface of and/or within spacer cover 511. Additionally, or alternatively, other elements (e.g., camera, alarm, speaker, microphone, smoke detector, security device, sensor, etc.) may be installed on and/or within spacer 510.

Figure 6A:
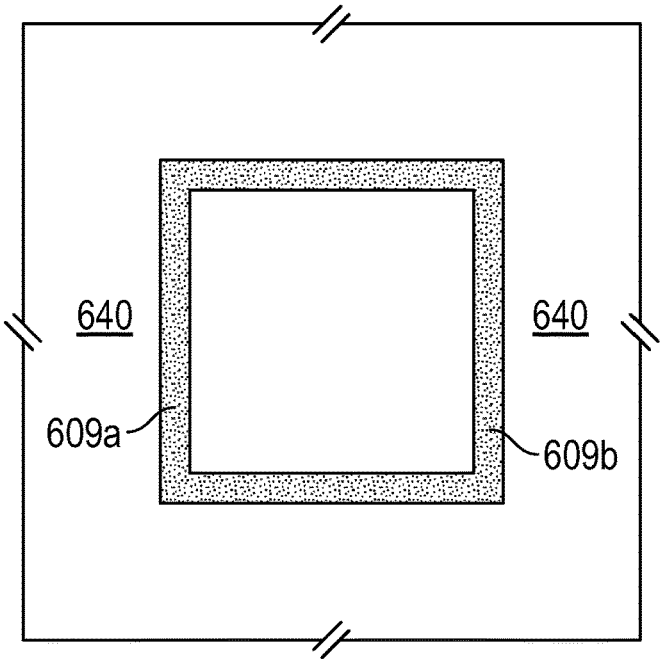
FIGS. 6A-6C are bottom elevational views of the example shade storage and deployment system of FIGS. 1A-1C.
Figure 6B:
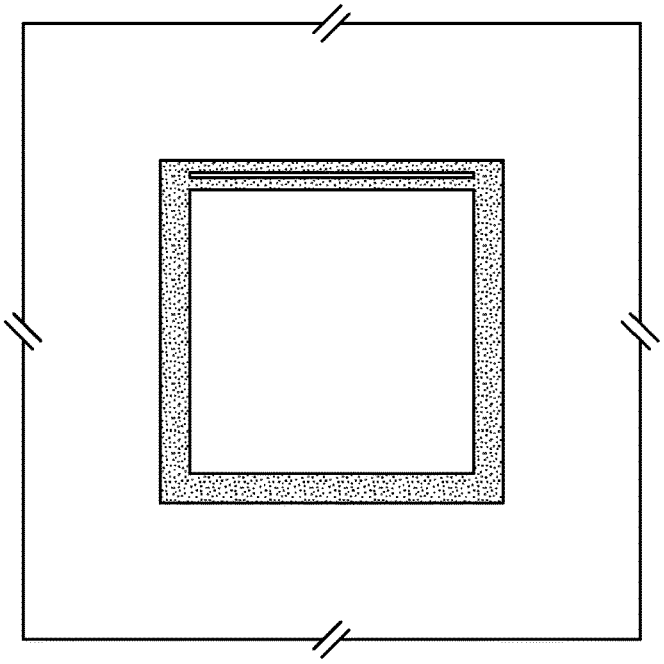
Figure 6C:
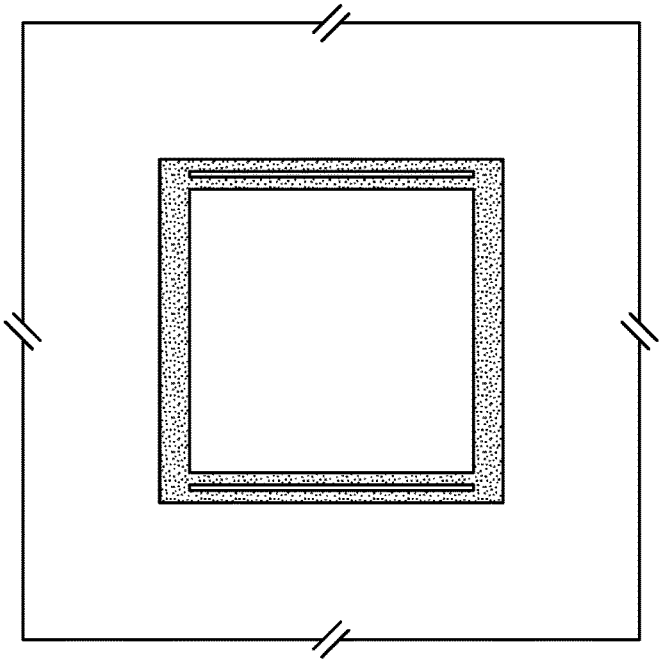
Figure 7:
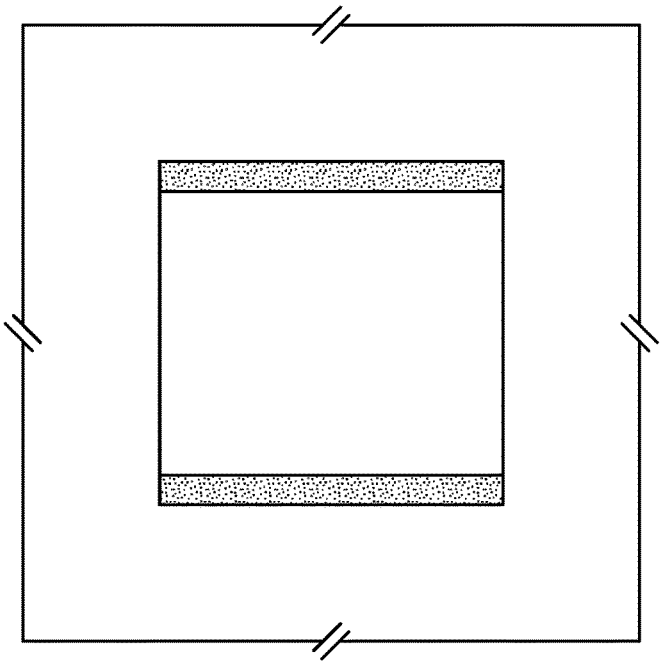
FIG. 7 is a bottom elevational view of an example shade storage and deployment system according to an implementation described herein.

FIGS. 6A-6C are bottom elevational views of the example shade storage and deployment system of FIGS. 1A-1C. Additionally, or alternatively, as shown in FIGS. 6A-6C, the spacer may be configured to create gaps 609*a* and/or 609*b*. For example, spacer 110 may be oriented to create gaps 609*a* and/or 609*b* between spacer 110 and ceiling covering 640. Gaps 609*a* and/or 609*b* may be adjustable in size in accordance with the techniques described herein. Gaps 609*a* and/or 609*b* may prevent the abutment of spacer 110 with ceiling covering 640. The size of gaps 107, 108, 609*a*, and/or 609*b* are not intended to be limiting.

The figures and description herein generally show spacer 110, gaps 107, 108, 609*a*, 609*b*, horizontal covering 105, and/or vertical covering 106 as generally being rectangular shape for explanatory purposes. In other implementations, the shape of spacer 110, gaps 107, 108, 609*a*, 609*b*, horizontal covering 105 and/or vertical covering 106 need not be so limited. Spacer 110, gaps 107, 108, 609*a*, 609*b*, horizontal covering 105 and/or vertical covering 106 may be of any shape. For example, gaps 107, 108, 609*a*, and/or 609*b* may include curved, concave, convex, zip-zag, circular, elliptical, triangular, square, pentangular, hexangular, octangular shapes, etc. The shape of gaps 107, 108, 609*a*, and/or 609*b* may be formed by the shapes of spacer 110, spacer covering 111, horizontal covering 105, and/or vertical covering 106, which may be of any shape (e.g., curved, concave, convex, zip-zag, circular, elliptical, triangular, square, pentangular, hexangular, octangular, etc.).

For example, as shown in FIGS. 9A-C and FIGS. 10A-C, spacer 910, 1010 may include convex and/or concave shapes. A curved shape of spacer 910, 1010 (and/or a curved shape of a horizontal covering, vertical covering, gap, partial opening of recess, etc.) may enable spacer 1010 to make contact with a shade and, based on the application, may control the shape (e.g., curvature, contour, deformation, etc.) of the shade as deployed through a gap. Such a curved shade may improve the aesthetic features of a room (e.g., by preventing a visually unpleasing juncture from forming between the horizontal and/or vertical coverings and the spacer, etc.)

In other implementations, the shape of the spacer, horizontal covering, vertical covering, gap, and/or partial opening of the recess shown in FIGS. 9A-C and FIGS. 10A-C need not be so limited. For example, the spacer, horizontal covering, vertical covering, gap, and/or partial opening of the recess may include a shape and/or be oriented to maintain parallel edges between the spacer and the horizontal and/or vertical coverings (e.g., FIGS. 6A, 9A). Said another way, the width of a gap may be generally constant, whether straight (e.g., FIG. 6A) or curved (e.g., FIG. 9A). Additionally or alternatively, the spacer, horizontal covering, vertical covering, gap, and/or partial opening of the recess may include a shape and/or be oriented such that the edges between the spacer and the horizontal and/or vertical coverings are not parallel. Said another way, the width of a gap may not be constant (e.g., FIGS. 10A-C). Additionally, or alternatively, the dimensions of the spacer may be increased to eliminate gaps 609*a* and/or 609*b*, as shown for example, in FIG. 7, which is a bottom elevational view of an example shade storage and deployment system according to an implementation described herein.

The described system may, for example, be installed according to the following method. One or more mount may be securely attached to at least a portion of a member of a structure. One or more tube may be removably and rotatably attached to the one or more mount. The one or more mount and/or one or more tube may be connected to a control mechanism configured to cause, at least, the tube to rotate. One or more shade may be securely attached to the one or more tube, such that a free end of the one or more tube may move away from and/or towards the tube when the tube is rotated. An attachment mechanism may be secured to at least a portion of a member of a structure. A spacer may be removably attached to the attachment mechanism via a fastener, to create one or more gap between the spacer and a ceiling base and/or a covering thereto. The spacer may be oriented to enable a free end of the one or more shade to move into and out of the one or more gap. The number and/or order of steps of the foregoing method are not intended to be limiting. Additionally, or alternatively, the method may include additional, fewer, and/or different steps and/or the steps may be performed in a different order than described herein. Additionally, or alternatively, one or more steps of the method may be repeated.

According to an alternative embodiment, a shade and curtain storage and deployment system includes both a shade assembly and a curtain assembly. The shade assembly and the curtain assembly are both at least partially contained within a recess defined in a ceiling. A spacer extends at least partially across an opening to the recess, defining a first gap and a second gap between the spacer and a surface of the ceiling on either side of the opening. A visible surface of the spacer is configured to extend in substantially the same plane as the surrounding ceiling and is visually substantially identical to the surrounding ceiling. A portion of the spacer including the visible surface is configured to be removable to facilitate access to the shade assembly and the curtain assembly. The shade assembly is configured to extend and retract a shade vertically through the first gap (e.g., to selectively cover and/or obscure a window, glass, wall, and room or portion thereof). The curtain assembly extends through the second gap and includes a curtain that hangs downward from the curtain assembly. The curtain assembly is configured to extend and retract the curtain assembly horizontally (e.g., to selectively cover and/or obscure the same window as the shade).

Figure 12A:
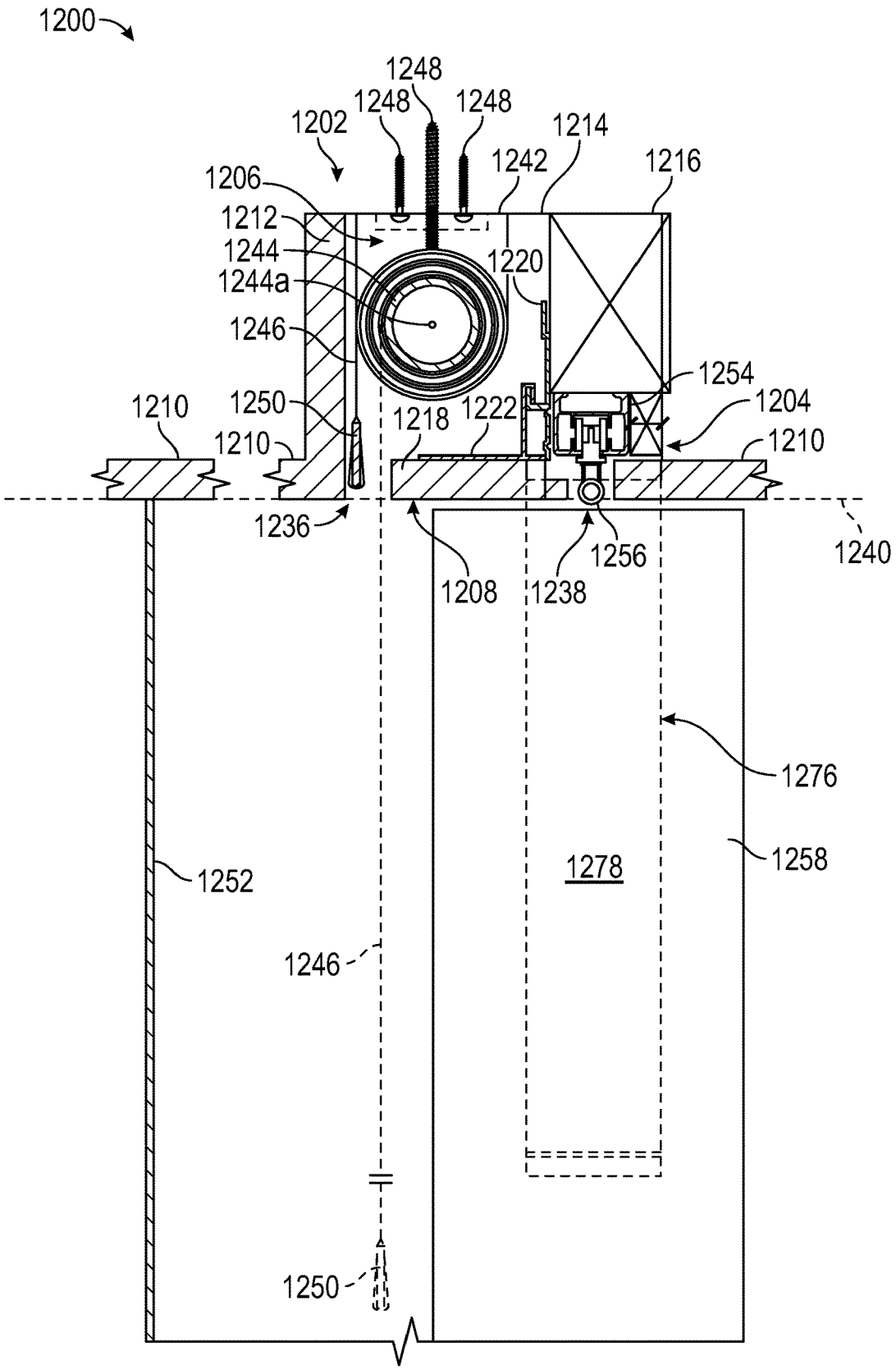
FIG. 12A is a side section view of an example shade and curtain storage and deployment system according to an implementation described herein.
Figure 12B:
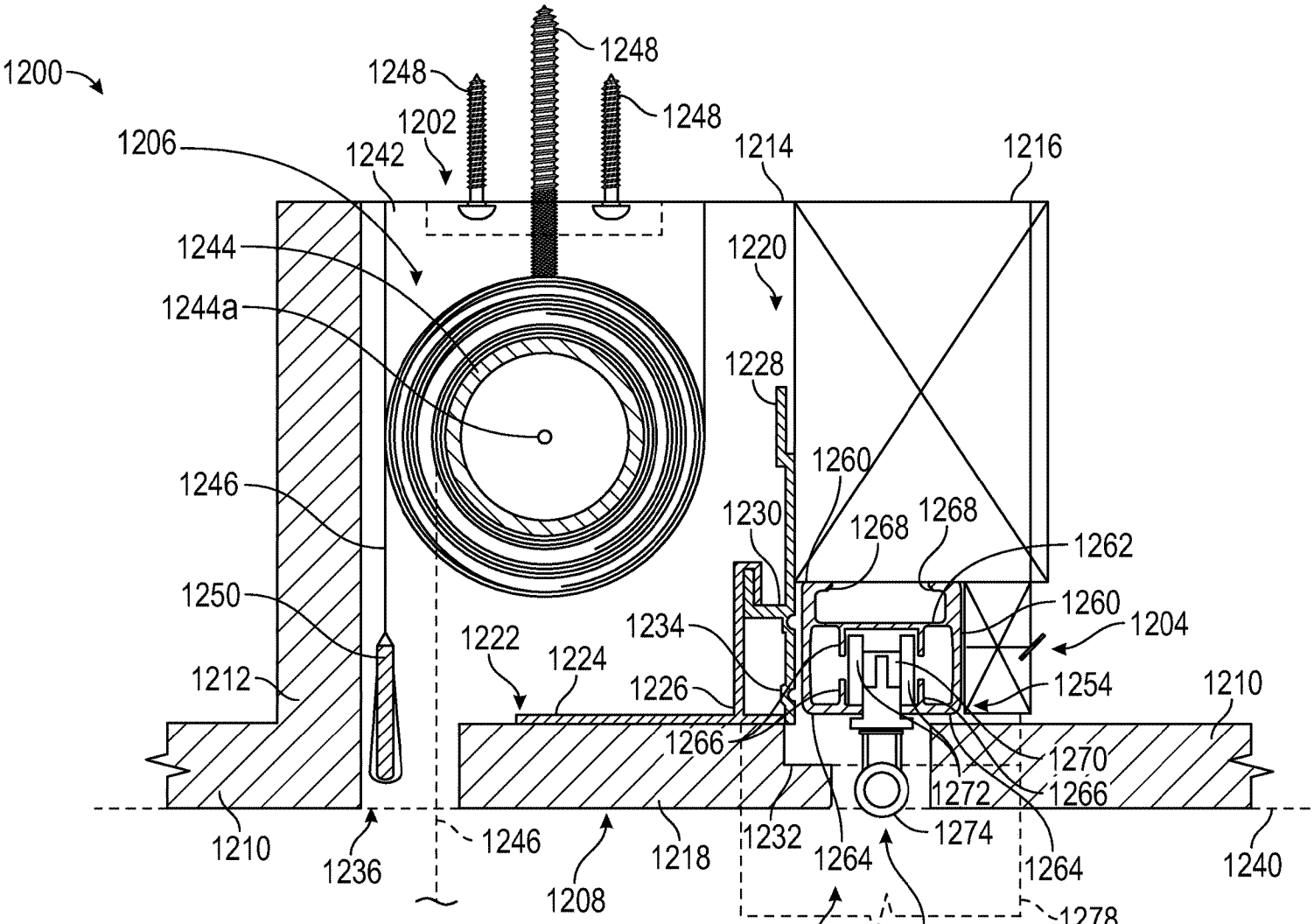
FIG. 12B is a detail view of the shade and curtain storage and deployment system of FIG. 12A.
Figure 12C:
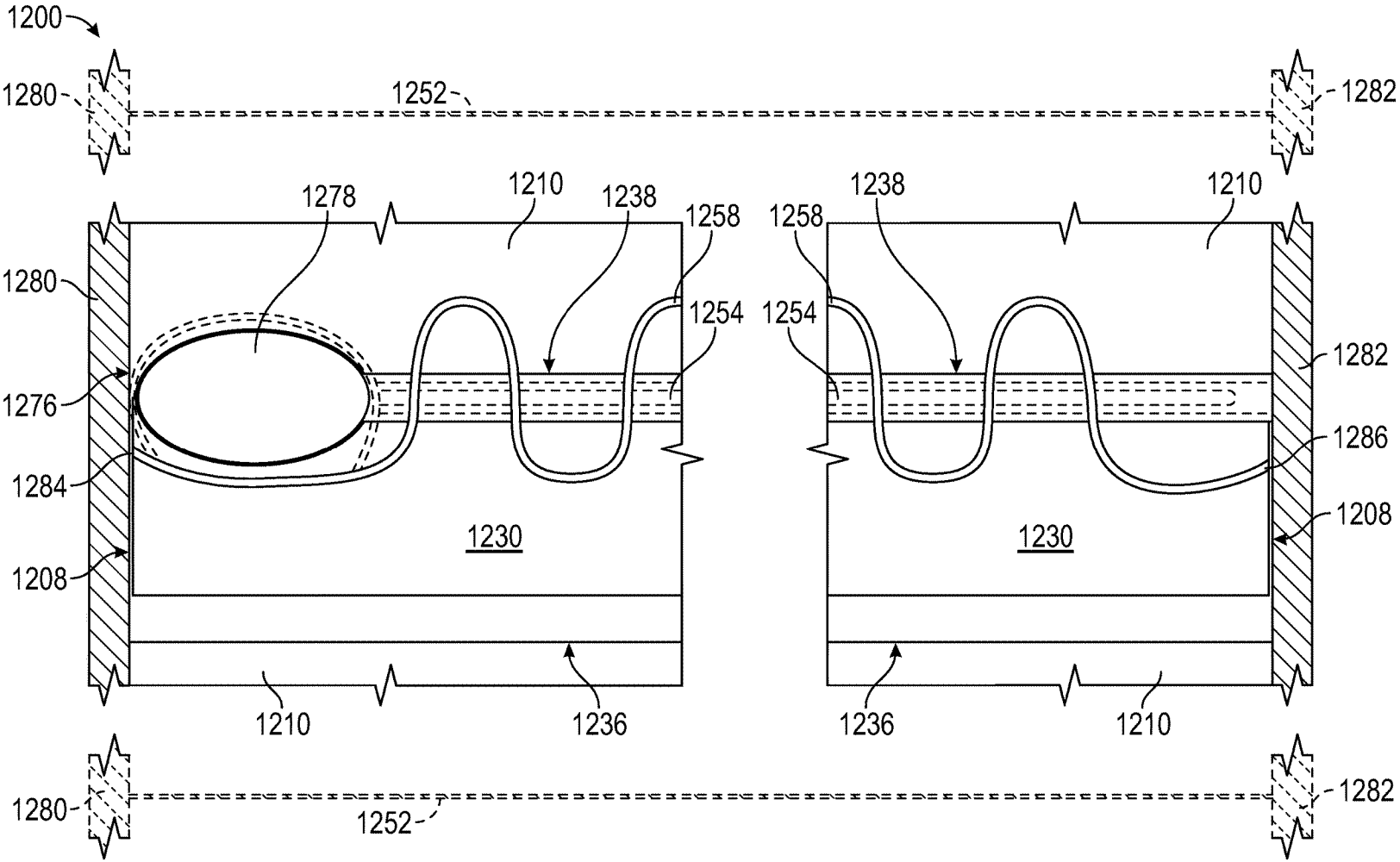
FIG. 12C is a bottom view of the shade and curtain storage and deployment system of FIG. 12A.
Figure 12D:
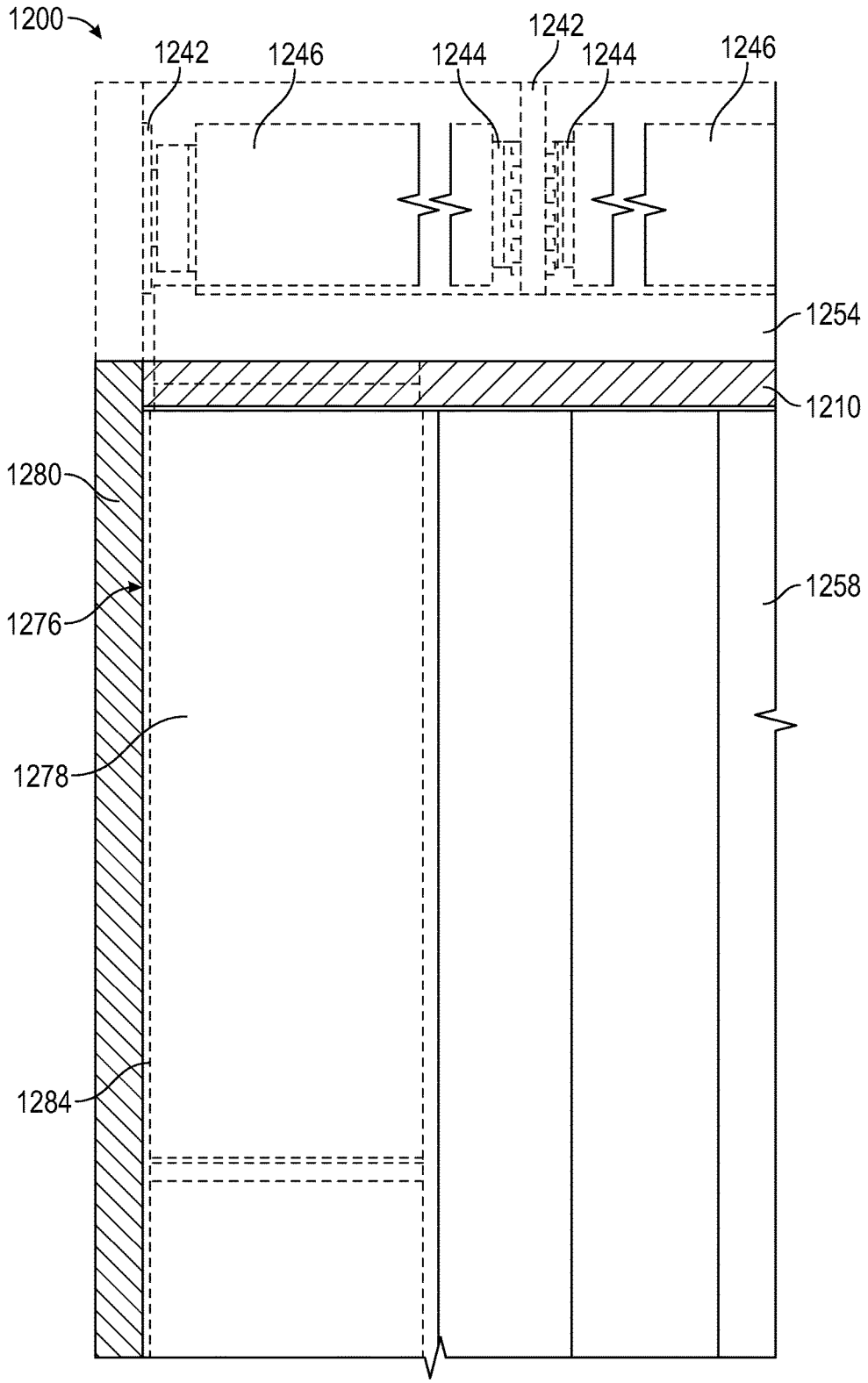
FIG. 12D is a front view of the shade and curtain storage and deployment system of FIG. 12A.
Figure 13:
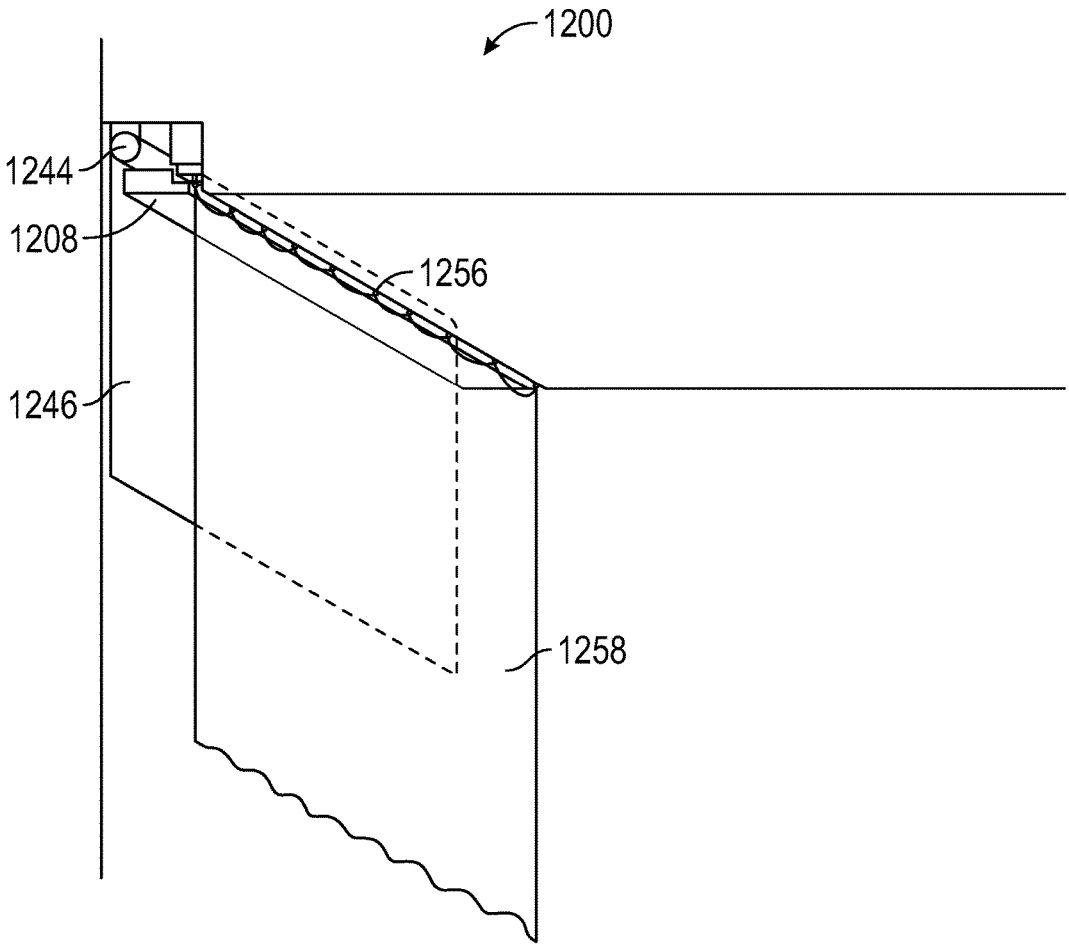
FIG. 13 is an illustration of a perspective cut-away view of the shade and curtain storage and deployment system of FIG. 12A.
Figure 14:
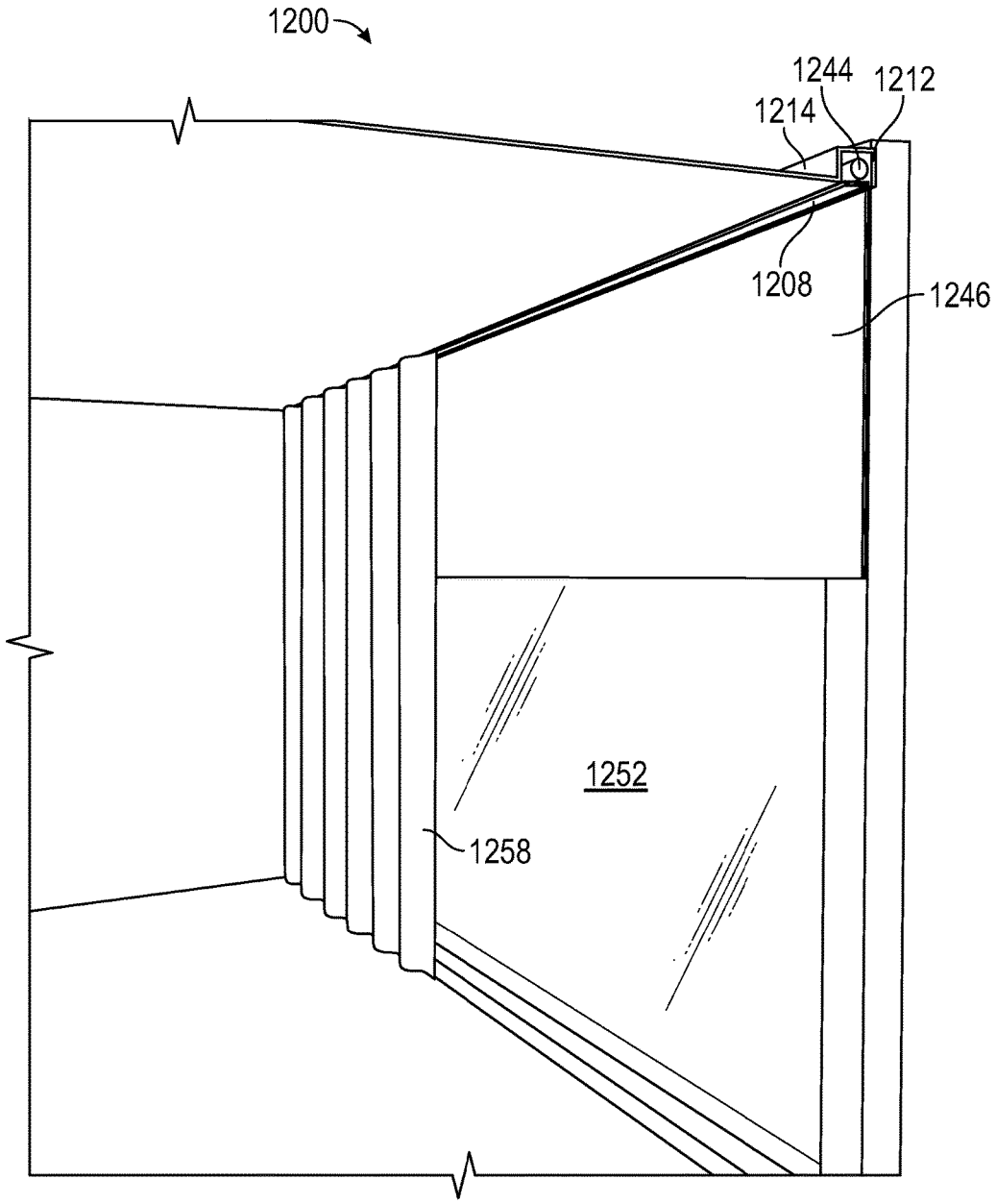
FIG. 14 is an illustration of a perspective cut-away view of the shade and curtain storage and deployment system of FIG. 12A showing the shade and curtain in a semi-retracted position.
Figure 15:
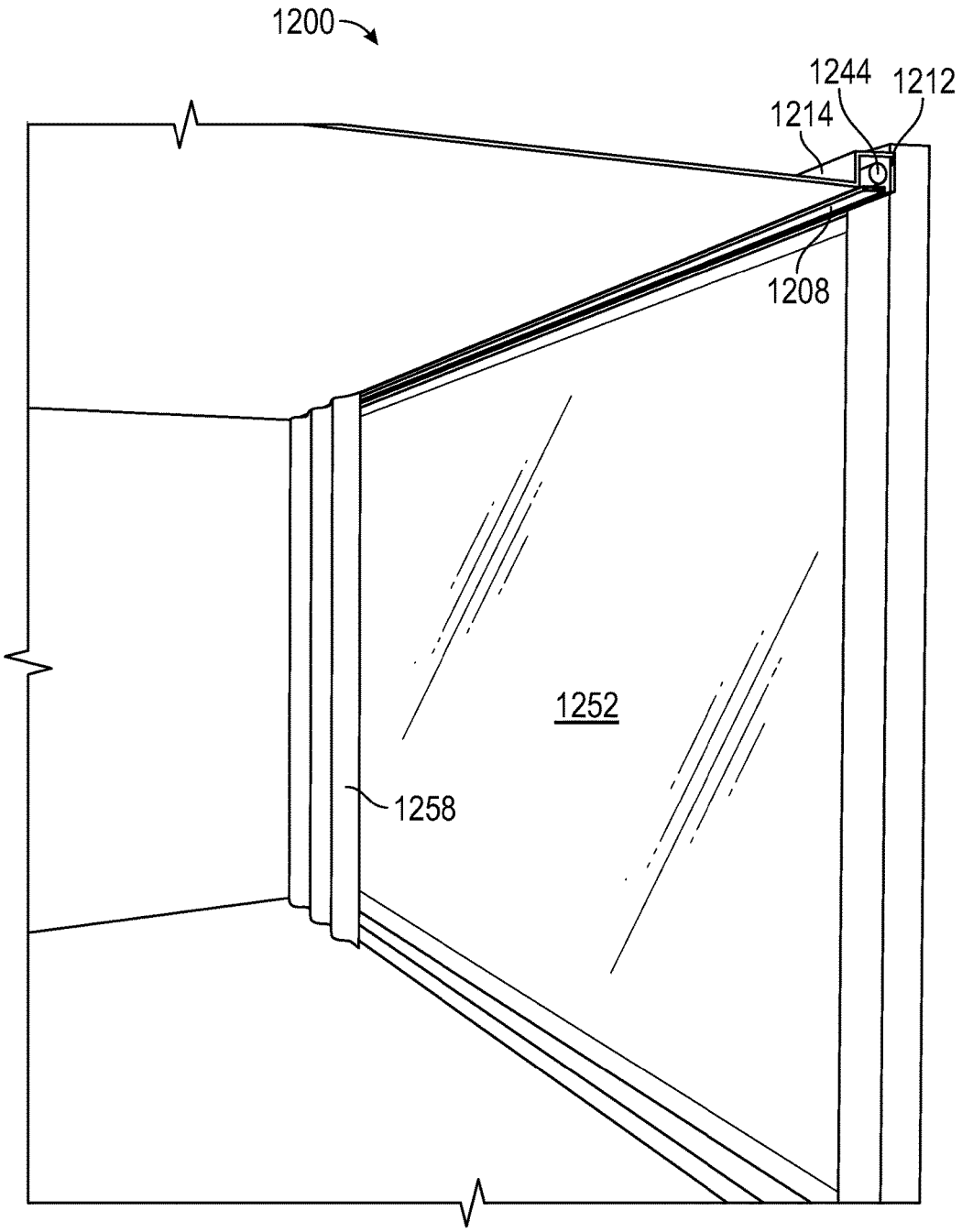
FIG. 15 is an illustration of a perspective cut-away view of the shade and curtain storage and deployment system of FIG. 12A showing the shade and curtain in a retracted position.
Figure 16:
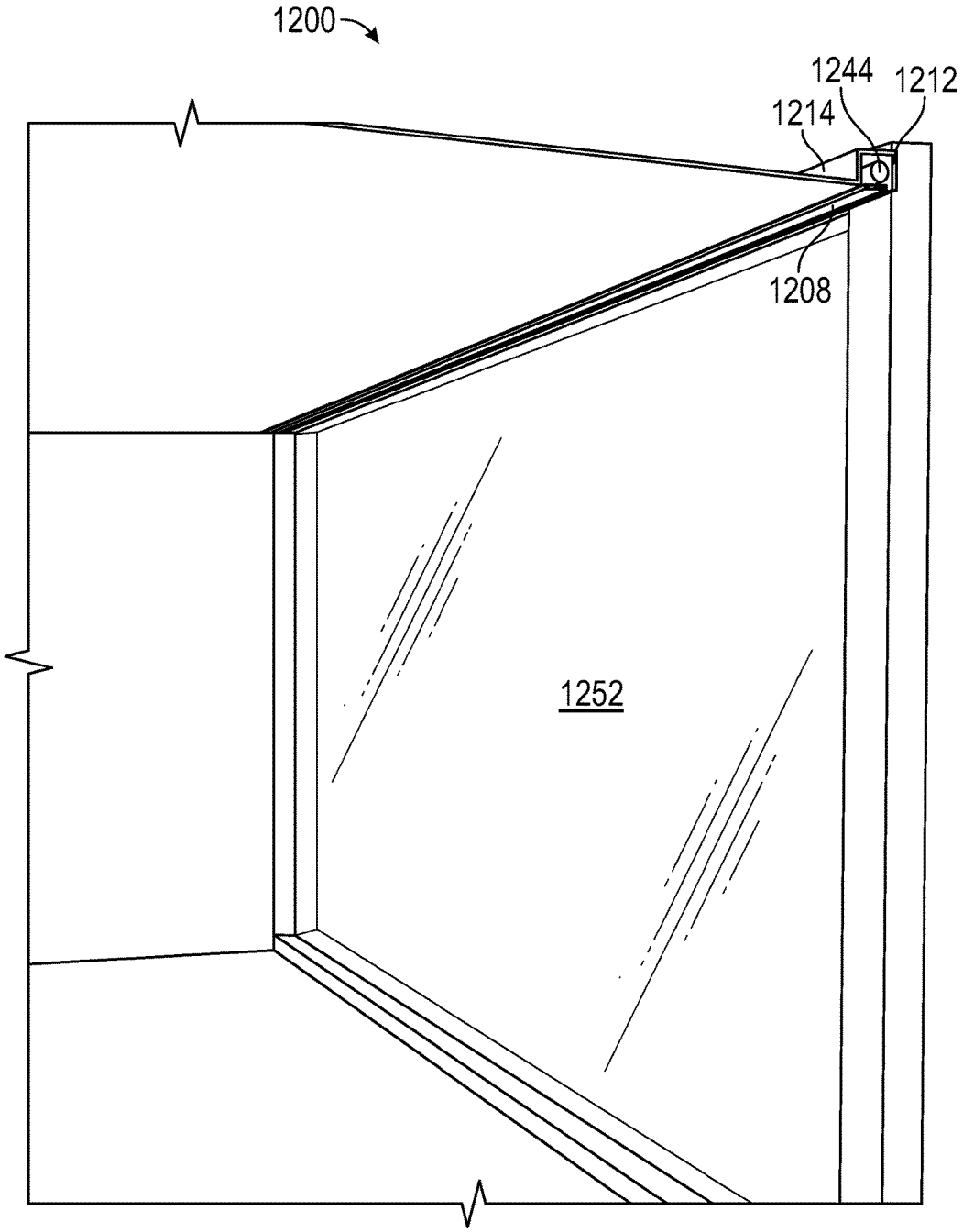
FIG. 16 is an illustration of a perspective cut-away view of the shade and curtain storage and deployment system of FIG. 12A according to an alternate embodiment.

Referring to FIGS. 12A-12D and FIGS. 13-16, a shade and curtain storage and deployment system is shown as system 1200 according to an exemplary embodiment. FIG. 12A is a side section view of the system 1200, FIG. 12B is a detail view of FIG. 12A, FIG. 12C is a bottom view of the system 1200, and FIG. 12D is a front view of the system 1200. FIG. 13 is an illustration of a perspective cut-away view of the system 1200. FIG. 14 is an illustration of a perspective cut-away view of the system 1200 showing a curtain 1258 in a semi-retracted position. FIG. 15 is an illustration of a perspective cut-away view of the system 1200 showing the shade and curtain in a retracted position. FIG. 16 is an illustration of a perspective cut-away view of the system 1200 according to an alternate embodiment.

The system 1200 includes a shade storage and deployment system, shown as shade assembly 1202, and a curtain storage and deployment system, hanging cover storage and deployment system, or hanging cover assembly, shown as curtain assembly 1204. The shade assembly 1202 and the curtain assembly 1204 can be contained in separate recesses in the ceiling or in the same recess and installed as a single unit. As shown in FIG. 12A, both the shade assembly 1202 and the curtain assembly 1204 extend into a recess 1206 which may be formed, for example, within a ceiling, wall, or other structural element. A spacer assembly or access panel, shown as access panel 1208, covers a portion of an opening of the recess. The shade assembly 1202, recess 1206, and access panel 1208 may together be substantially similar to the system 100 except as otherwise discussed herein.

Referring to FIG. 12B, the recess 1206 extends above a visible surface of a ceiling. The recess 1206 may be substantially similar to the recess 130 except as otherwise stated herein. The visible surface of the ceiling is at least partially defined by horizontal coverings 1210 (e.g., made of plaster, wood, sheet rock, ceramic, metal, or a combination thereof, etc.). The ceiling may additionally or alternatively include one or more vertical coverings 1212 (e.g., made of plaster, wood, sheet rock, ceramic, metal, or a combination thereof, etc.) that partially define an inner surface of the recess 1206. The ceiling may include a ceiling base (e.g., joist, beam, truss, etc.) configured to support one or more of the horizontal coverings 1210 and/or the vertical coverings 1212. An opening to the recess is defined by one or more of the ceiling base, the horizontal coverings 1210, and the vertical coverings 1212. The horizontal coverings 1210, the vertical coverings 1212, and the ceiling base may be substantially similar to the horizontal coverings 105, the vertical coverings 106, and the ceiling base 104, respectively.

One or more upper surfaces of the recess 1206 are defined by an upper structure 1214. The upper structure 1214 may include joists, beams, trusses, floor boards, or other structural elements. The upper structure 1214 may be made with a material of sufficient strength to support one or more of the shade assembly 1202 and the curtain assembly 1204. The upper structure 1214 may additionally or alternatively support the ceiling base. Disposed within the recess 1206 is a support, shown as beam 1216, that extends in a depth direction (e.g., perpendicular to the plane of FIG. 12B). In other embodiments, the beam 1216 is any component sufficient to support the weight and/or forces upon the access panel 1208 and/or the curtain assembly 1204 (e.g., a joist, a truss, a block, etc.). The beam 1216 may be part of the ceiling (e.g., part of the ceiling base) or another component that is attached to the ceiling. The beam 1216 is fixed relative to the recess (e.g., by fixedly coupling to the upper structure 1214). The beam 1216 extends downward, away from the upper structure 1214, but remains within the recess 1206. The beam 1216 defines a side surface and a bottom surface.

The access panel 1208 includes a cover, shown as spacer covering 1218 and a first support, shown as removable support 1222. A second support, shown as fixed support 1220, couples the access panel 1208 to the ceiling. The spacer covering 1218 extends horizontally within the opening of the recess 1206. As shown in FIG. 12B, the spacer covering 1218 extends at least partially directly beneath the beam 1216. The removable support 1222 includes a base 1224 and an extension or attachment member, shown as hook 1226. The base 1224 extends horizontally along a top surface of the spacer covering 1218 and is fixedly coupled to the spacer covering 1218. The hook 1226 extends vertically upward from the base 1224. The fixed support 1220 includes a base 1228 and an extension or attachment member, shown as hook 1230. The base 1228 extends vertically along the side surface of the beam 1216 and is fixedly coupled to the beam 1216. The hook 1230 extends horizontally outward from the base 1228. The removable support 1222 and the fixed support 1220 cooperate to removably couple the spacer covering 1218 to the beam 1216, holding the spacer covering 1218 within the opening. The hook 1226, which opens downward, receives the hook 1230, which opens upward. Accordingly, the hook 1230 supports the weight of the spacer covering 1218 and the removable support 1222. To prevent the spacer covering 1218 from rotating about the interface between the hook 1226 and the hook 1230 due to gravity, the base 1224 and the base 1228 extend to contact one another along a vertical surface, counteracting the moment loading produced by the weight of the spacer covering 1218.

To remove the access panel 1208 from the recess 1206, an upward substantially vertical force may be applied to the spacer covering 1218, disengaging the hook 1226 from the hook 1230. As shown in FIG. 12B, a portion 1232 of the spacer covering 1218 extending directly beneath the base 1228 is cut away to form a vertically-extending gap between the spacer covering 1218 and the base that prevents interference between the base 1228 and the spacer covering 1218 when the spacer covering is removed. The base 1228 further defines a protrusion 1234 extending laterally outward from the base 1228. As the removable support 1222 moves upward, the base 1224 rides along a surface of the base 1228. When the base 1224 reaches the protrusion 1234, the base 1224 can rotate away from the base 1228 to clear the protrusion 1234. In some embodiments, the protrusion 1234 prevents accidental removal of the spacer covering 1218, as removal of the spacer covering 1218 requires the user to impart both a vertical and a lateral force to remove the spacer covering 1218. Removing the spacer covering 1218 facilitates access to the components of the shade assembly 1202 and the curtain assembly 1204 located within the recess 1206 (e.g., for maintenance). In other embodiments, the spacer covering 1218 is removably held within the opening of the recess 1206 using a different mechanism (e.g., a magnet, a fastener, etc.).

Referring to FIGS. 12B and 12C, the spacer covering 1218 extends partially across the opening of the recess 1206. A first opening, gap, or aperture, shown as gap 1236, is defined between a first visible bottom edge of the spacer covering 1218 and a visible bottom edge of the ceiling (e.g., an edge of a horizontal covering 1210). A second opening, gap, or aperture, shown as gap 1238 is defined between a second visible bottom edge of the spacer covering 1218 opposite the first edge and another visible bottom edge of the ceiling (e.g., an edge of another horizontal covering 1210). The gap 1236 and the gap 1238 extend between the visible surface of the spacer covering 1218 and the visible surface of the ceiling (e.g., the horizontal coverings 1210, the vertical coverings 1212). In some embodiments, the system 1200 includes a tool (e.g., a jig) configured to assist a user in properly spacing the components that make up the visible surface of the ceiling (e.g., the horizontal coverings 1210, the vertical coverings 1212, etc.) during installation of the system 1200. By way of example, the tool may be a spacer of a predetermined size corresponding to the total width of the gap 1236, the gap 1238, and the spacer covering 1218.

As shown in FIG. 12B, the edges defining the gap 1236 and the gap 1238 are straight and parallel to one another. In other embodiments, the edges may each be curved, angled, segmented (e.g., as in the outer edge of a polygon), or have another type of contour. In some embodiments, each pair of edges that defines a gap have matching contours such that a width of the gap 1236 and/or a width of the gap 1238 are each uniform along their entire length. The contours of the edges defining the gap 1236 may or may not match the contours of the edges defining the gap 1238. In some embodiments, the edges defining each gap do not have matching contours.

As shown in FIGS. 12A and 12B, the bottom surface of the spacer covering 1218 and the bottom surfaces of the horizontal coverings 1210 are all aligned such that they extend within the same plane 1240. Accordingly, the surfaces of the ceiling visible to a viewer positioned below the system 1200 (e.g., the bottom surfaces of the horizontal coverings 1210) and the access panel 1208 (e.g., the bottom surface of the spacer covering 1218) visually appear as one level (e.g., having the same vertical position) surface that is continuous except where broken by the gap 1236 and the gap 1238. In embodiments where the ceiling is slanted relative to a horizontal plane, the plane 1240 is slanted such that the visible surfaces of the ceiling and the access panel 1208 all follow the same slant. Further, the horizontal coverings 1210 and the spacer covering 1218 may all be made from the same material, such that the visible surfaces of the ceiling and the access panel 1208 share the same color, texture, reflectivity, opacity, and/or other visual characteristic (i.e., are visually substantially identical). Alternatively, the horizontal coverings 1210 and the spacer covering 1218 may be made from different materials having similar visual characteristics, such that the visible surfaces of the ceiling and the access panel 1208 share the same color, texture, reflectivity, opacity, and/or other visual characteristic such that they appear visually substantially identical.

Referring to FIGS. 12A and 12B, the shade assembly 1202 is shown according to an exemplary embodiment. The shade assembly 1202 includes two or more mounts 1242, a tube 1244, and a shade 1246. The mounts 1242, the tube 1244, and the shade 1246 may be substantially similar to the mounts 101, the tube 102, and the shade 103, respectively, and may be arranged similarly to the system 100. The mounts 1242 are coupled to the upper structure 1214 using fasteners 1248. The fasteners 1248 may extend into and/or engage one or both of the mounts 1242 and the upper structure 1214. In other embodiments, the mounts 1242 may be coupled to a different part of the structure defining or arranged within the recess 1206 (e.g., the vertical covering 1212, the beam 1216, etc.). The tube 1244 is rotatably coupled to the mounts 1242 and configured to rotate about an axis 1244*a*. As shown in FIG. 12A, the axis 1244*a* extends parallel to the gap 1236 and the spacer covering 1218. The mount 1242 and/or the tube 1244 may include bearings or other components to facilitate rotation of the tube 1244. The shade 1246 wraps around the tube 1244 such that rotation of the tube 1244 extends or retracts the shade 1246. In some embodiments, the shade 1246 includes a weight 1250 coupled to a lowermost edge of the shade 1246. The weight 1250 applies tension to the shade 1246 to hold the shade 1246 taut.

As the tube 1244 rotates counterclockwise as shown in FIG. 12B, the shade 1246 extends, moving vertically downward through the gap 1236. As the tube 1244 rotates clockwise as shown in FIG. 12B, the shade 1246 retracts, moving vertically upwards. The shade 1246 moves between a fully retracted position, shown in solid lines in FIGS. 12A and 12B, and a fully extended position. The shade 1246 is shown in an intermediate position between the fully extended and fully retracted positions in dashed lines in FIGS. 12A and 12B. In the fully retracted position, the shade 1246 moves up through the gap 1236 such that the entirety of the shade 1246 is disposed above the plane 1240. In some embodiments, the shade 1246 is obscured by the spacer covering 1218 in the fully retracted position such that the shade 1246 is not visible. In the fully extended position, the shade 1246 extends below the plane 1240. In some embodiments, the shade 1246 partially or completely obscures a window 1252 while in the fully extended position.

The mounts 1242 and/or the tube 1244 may be configured to connect to a control mechanism (e.g., motor, servo, air compressor, hydraulic, pneumatic, and/or some other mechanical control system) that is configured to provide a force (e.g., torque on a pin or bearing) to the mount 1242 and/or the tube 1244 to cause at least tube 1244 to rotate. The control mechanism may be configured to be in wired and/or wireless communication with a user device (e.g., input device, keypad, PDA, phone, laptop, computer, remote control, etc.), sensor (e.g., motion, temperature, pressure, position, etc.), and/or other device (e.g., timer, measurement device, light switch, door, window, television, etc.). The user device, sensor, and/or other device may be configured to send a signal to the control mechanism to automatically rotate (e.g., counter-clockwise, clockwise) the tube 1244 about the axis 1244*a* and/or at least a portion of the mounts 1242.

As the shade 1246 wraps or unwraps while moving between the fully retracted and fully extended positions, the lateral position of the shade 1246 in the gap 1236 changes. As shown in FIG. 12B, the gap 1236 is of a sufficient width that the shade 1246 does not contact the horizontal covering 1210 or the access panel 1208 anywhere between the fully extended and fully retracted positions. In other embodiments, the gap 1236 is sized such that the shade 1246 contacts at least one of the horizontal covering 1210 and the access panel 1208. In some such embodiments, one or both of the horizontal covering 1210 and the access panel 1208 include a deflector similar to the deflector 112 that deflect the shade 1246 into the gap 1236.

As shown in FIGS. 12A and 12B, the curtain assembly 1204 includes a track 1254, a number of hangers 1256 configured to ride in the track 1254, and a hanging cover, shown as curtain 1258 that hangs downward from the hangers 1256. Unlike the shade 1246, which moves upward and downward, sometimes moving entirely inside of the recess 1206, the curtain 1258 moves horizontally, remaining at least partially outside of the recess 1206 (e.g., below the plane 1240). The hangers 1256 support the curtain 1258 at regular intervals along the length of the curtain 1258 such that, as the curtain 1258 retracts, the curtain 1258 folds over upon itself. The curtain 1258 is made of fabric, plastic, or another material sufficiently flexible to fold over upon itself and sufficiently opaque to block at least some light.

Referring to FIG. 12B, a cross section of the track 1254 is shown. The track 1254 includes a pair of walls, shown as vertical walls 1260, a cross member 1262 extending between the vertical walls 1260, and a pair of lower walls, shown as retaining walls 1264. The vertical walls 1260 define a width of the track 1254 that varies with the spacing between the vertical walls 1260. A chamber is defined between the vertical walls 1260, the cross member 1262, and the retaining walls 1264. The retaining walls are spaced apart from one another, defining a gap through which the chamber can be accessed. A number of walls, shown as guide walls 1266, extend into the chamber from the cross member 1262 and the retaining walls 1264.

The track 1254 is fixed relative to the recess 1206. In some embodiments, the track 1254 is fixedly coupled (e.g., fastened) to the beam 1216. As shown in FIG. 12B, the track 1254 is fixedly coupled to the bottom surface of the beam 1216. Each vertical wall 1260 defines a protrusion 1268 extending toward the other vertical wall 1260. The system 1200 may include an adaptor configured to fit within the space defined between the vertical walls 1260, the cross member 1262, and the protrusions 1268 that is coupled (e.g., fastened, adhered, etc.) to the beam 1216. This adaptor may then engage the protrusions 1268 to hold the track 1254 in place. In other embodiments, the track 1254 is otherwise fixed relative the recess 1206.

The hangers 1256 each include a body 1270, a pair of bearing elements or low friction elements (e.g., wheels, sliders, etc.), shown as rollers 1272, and an interface 1274. The rollers 1272 are rotatably coupled to the body 1270 and concentrically aligned. In the embodiment shown in FIG. 12B, the body 1270 extends through the gap between the retaining walls 1264 and into the chamber. Each of the rollers 1272 is located within the chamber, resting upon an upper surface of one of the retaining walls 1264. Accordingly, the hangers 1256 are configured to roll along the length of the track 1254, remaining within the gap between the retaining walls 1264. The guide walls 1266 are arranged in proximity to an outer side of each roller 1272, preventing the body 1270 and the rollers 1272 from rotating about a vertical axis. The interface 1274 is coupled to the body 1270 and extends downward from the track 1254. The interface 1274 is configured to couple to the curtain 1258 near a top edge of the curtain 1258. By way of a first example, the curtain 1258 may include a number of eyelets each defining an aperture. The interface 1274 may be a corresponding hook configured to pass through the aperture to couple the hangers 1256 to the curtain 1258. By way of another example, the interface 1274 may include a hook coupled to (e.g., sewn into) the curtain 1258. The interface 1274 may further include a corresponding ring coupled to the body 1270 that receives the hooks from the curtain 1258. In some embodiments, the interface 1274 is rotatable relative to the body 1270 (e.g., about a vertical axis) to facilitate rotation of the curtain 1258 while folding or straightening.

The interfaces 1274 of the hangers 1256 extend into the gap 1238 to meet the curtain 1258. In some embodiments, the interfaces 1274 extend beyond the plane 1240. In other embodiments, the interfaces 1274 remain above the plane 1240, and the curtain 1258 extends above the plane 1240 to meet the interface 1270. The curtain 1258 itself (e.g., the folding material of the curtain 1258) may alternatively be disposed entirely below the plane 1240, while remaining adjacent the plane 1240. This prevents the curtain 1258 from binding in the gap 1238 as the curtain 1258 folds. Due to the placement of the curtain 1258 below the plane 1240, the gap 1238 may be just slightly wider than the larger of the body 1270 and the interface 1274 without interfering with the movement of the hangers 1256. Accordingly, the horizontal covering 1210 and the spacer covering 1218 extend between the vertical walls 1260, such that the horizontal covering 1210 and the spacer covering 1218 extend directly beneath the track 1254. This facilitates the horizontal covering 1210 and the access panel 1208 obscuring the track 1254 from view, resulting in a negative reveal configuration.

In some embodiments, the curtain assembly 1204 further includes a control mechanism (e.g., motor, servo, air compressor, hydraulic, pneumatic, and/or some other mechanical control system), shown as motor 1276, configured to selectively extend and retract the curtain 1258. The motor 1276 may be configured to be in wired and/or wireless communication with a user device (e.g., input device, keypad, PDA, phone, laptop, computer, remote control, etc.), sensor (e.g., motion, temperature, pressure, position, etc.), and/or other device (e.g., timer, measurement device, light switch, door, window, television, etc.). The user device, sensor, and/or other device may be configured to send a signal to the motor 1276 to automatically extend or retract the curtain 1258 along the track 1254.

The motor 1276 includes a body 1278 and a shaft that extends from the body 1278. The body 1278 is configured to rotate the shaft (e.g., in response to electricity being applied to the motor 1276). The body 1278 is fixed relative to the track 1254 such that the shaft rotates relative to the track 1254. By way of example, fasteners may extend between the track 1254 and the body 1278, coupling the body 1278 to the track 1254. The body 1278 extends below the plane 1240. In some embodiments, the body 1278 is disposed completely below the plane 1240. In other embodiments, the body 1278 extends partially above the plane 1240. Accordingly, in such embodiments, portions of the horizontal covering 1210 and the spacer covering 1218 may be cut away to provide clearance for the body 1278. The motor 1276 is disposed between the curtain 1258 and the window 1252 such that the motor 1276 is obscured from view.

The motor 1276 is configured to move one or more of the hangers 1256 to extend and retract the curtain 1258. According to an exemplary embodiment, the shaft of the motor 1276 extends above the plane 1240 to connect to and rotate a first pulley disposed near a first end of the track 1254. A second pulley acting as an idler pulley is rotatably coupled to the track 1254 near a second end of the track 1254 opposite the first end. A belt (e.g., a timing belt, a flat belt, etc.) engages the first pulley and the second pulley, extending along the length of the track 1254. The hanger 1256 closest to one end (e.g., a movable end opposite a fixed end) of the curtain 1258 is coupled to the belt such that the hanger 1256 moves along the length of the track 1254 as the belt rotates. Accordingly, rotation of the shaft of the motor 1276 pulls the hanger 1256 that is connected to the belt, extending or retracting the curtain 1258 depending upon the direction of rotation of the shaft. The movement of this hanger 1256 is linked to the movement of the other hangers 1256 by the curtain 1258.

Referring to FIGS. 12C and 12D, a bottom view and a front view of the system 1200 are shown. The system 1200 extends between a first wall, shown as wall 1280, and a second wall, shown as wall 1282, and is configured to selectively obscure the window 1252. It should be understood, however, that this arrangement is not intended to be limiting. In alternative embodiments, the system 1200 does not extend to one or more walls and/or does not obscure a window.

A fixed end of the curtain 1258 adjacent a fixed edge 1284 is fixed relative to the ceiling and disposed near the wall 1280. The curtain 1258 is fixed at at least one point that is disposed adjacent the fixed edge 1284 (i.e., on the fixed end). The curtain 1258 may be fixed to the ceiling or to another component that is stationary relative to the ceiling (e.g., the ceiling base, the horizontal covering 1210, the wall 1280, the track 1254, the motor 1276, etc.). By way of example, the fixed edge 1284 of the curtain 1258 may be fixed to the body 1278 of the motor 1276 or to another portion of the curtain 1258. In one such example, shown in dotted lines in FIG. 12C, the curtain 1258 doubles back upon itself, wrapping (e.g., partially or completely) around the body 1278. In such an example, both a frontward-facing portion (e.g., a curved face, a flat face, etc.) of the body 1278 that faces away from the window 1252 and a rearward-facing portion of the body 1278 that faces toward the window 1252 are obscured from view by the curtain 1258. As shown in FIG. 12C, in a fully extended position, a movable edge 1286 of the curtain 1258 opposite the fixed end (i.e., on a movable end) is extended away from the motor 1276 and is disposed proximate the wall 1282, such that the window 1252 is fully or nearly fully obscured by the curtain 1258. In a fully retracted position, the movable edge 1286 of the curtain 1258 is moved away from the wall 1282 and toward the motor 1276 such that the curtain 1258 folds upon itself near the motor. In the fully retracted position, the curtain 1258 obscures a minimal amount of the window 1252.

When folded, the curtain 1258 utilizes space on both sides of the track 1254. To accommodate this, the curtain assembly 1204 is preferably spaced away from other components that would otherwise interfere with the folded curtain (e.g., the shade 1246, the window 1252, etc.). Because the shade 1246 rolls up instead of folding, the shade assembly 1202 does not require this spacing. Accordingly, the folds of the curtain can be disposed directly below the tube 1244 without interfering with the shade 1246. In some embodiments, the shade assembly 1202 can be placed such that the shade 1246 is adjacent the window 1252, minimizing the overall size of the system 1200. In alternative embodiments, however, the curtain assembly 1204 is disposed between the shade assembly 1202 and the window 1252. The placement of the window 1252 in both of these embodiments is shown in FIG. 12C in dashed lines.

In some embodiments, both the shade assembly 1202 and the curtain assembly 1204 are disposed at least partially within a continuous volume defined within the ceiling by the recess 1206. By way of example, the volume may be defined by the plane 1240, the vertical covering 1212, the upper structure 1214, and the beam 1216. No components completely separate a first area of the volume at least partially containing the shade assembly 1202 from a second area of the volume at least partially containing the curtain assembly 1204. The first area and the second area are fluidly coupled such that a gas (e.g., oxygen, ambient air) can travel between the first area and the second area without the gas traveling outside of the ceiling. Accordingly, no components (e.g., the fixed support 1220, the access panel 1208, etc.) or elements of the ceiling (e.g., the beam 1216) completely separate the first and second areas.

The shade 1246 and the curtain 1258 may have varying levels of opacity (e.g., may let in varying amounts of light). In some embodiments, the opacity of the shade 1246 and the opacity of the curtain 1258 are different. By way of one example, the curtain 1258 may have a lesser opacity than (e.g., may transmit more light than) the shade 1246. Utilizing different levels of opacity in the shade 1246 and the curtain 1258 facilitates greater control over the amount of light transmitted into a room (e.g., through the window 1252).

Although the system 1200 is described as having a certain number of components, it should be understood that the system 1200 may include more or fewer components while still performing the same functions. By way of example, the spacer covering 1218 and the removable support 1222 may be integrally formed as a single piece. In some such embodiments, a visible surface corresponding to the bottom surface of the spacer covering 1218 may be configured (e.g., painted, coated, etc.) to be visually substantially identical to the visible surfaces of the ceiling surrounding the spacer covering 1218 (e.g., the horizontal coverings 1210). By way of another example, the horizontal covering 1210 and the vertical covering 1212 are shown as being integrally formed as a single piece which has a uniform visual appearance. In other embodiments, the horizontal covering 1210 and the vertical covering 1212 are separate components that are visually substantially identical.

The system 1200 may, for example, be installed according to the following method. A mount 1242 may be securely attached to at least a portion of a member of a structure. A tube 1244 may be removably and rotatably attached to the mount 1242. The mount 1242 and/or the tube 1244 may be connected to a control mechanism configured to cause, at least, the tube 1244 to rotate. A shade 1246 may be securely attached to the tube 1244, such that a free end of the shade 1246 may move away from and/or towards the tube 1244 when the tube 1244 is rotated. A track 1254 including a number of hangers 1256 may be securely attached to at least a portion of a member of a structure. A fixed support 1220 may be secured to at least a portion of a member of a structure. A spacer covering 1218 may be removably attached to the fixed support 1220 by a removable support 1222, creating a gap 1236 and/or a gap 1238 between the spacer covering 1218 and a ceiling base and/or a covering thereto. The spacer covering 1218 may be oriented to enable a free end of the shade 1246 to move into and out of the gap 1236. A curtain 1258 may be attached to the hangers 1256 and oriented such that the curtain 1258 extends through the gap 1238 to hang below the spacer covering 1218. One or more of the hangers 1256 may be connected to a motor 1276 configured to cause, at least, one end of the curtain 1258 to translate. The system 1200 may include more, fewer, and/or different components than described herein. The number and/or order of steps of the foregoing method are not intended to be limiting. Additionally, or alternatively, the method may include additional, fewer, and/or different steps and/or the steps may be performed in a different order than described herein. Additionally, or alternatively, one or more steps of the method may be repeated.

Referring now to FIG. 13, an illustration of a perspective cut-away view of the system 1200 is shown according to an example embodiment. As shown, the shade 1246 is in a semi-retracted position located between the extended and retracted positions, and the curtain 1258 is in the extended position. In this arrangement, the curtain 1258 obscures the entirety of the shade 1246 from view. In this embodiment, the recess 1206 is disposed adjacent the window 1252 such that the window 1252 defines a portion of the recess 1206. It should be understood, however, that the recess 1206 may have various spacings relative to the window 1252. Additionally, the hangers 1256 extend immediately below the plane 1240 to facilitate hanging the curtain 1258 without interference between the curtain 1258 and the access panel 1208 or the ceiling.

Referring now to FIGS. 14 and 15, illustrations of a perspective cut-away view of the system 1200 are shown according to an example embodiment. FIG. 14 shows the shade 1246 and the curtain 1258 each in a semi-retracted position between the extended and retracted positions. FIG. 15 shows the shade 1246 and the curtain 1258 each in the retracted position. In this embodiment, the recess 1206 is adjacent the window 1252. Unlike the embodiment shown in FIG. 13, however, a vertical covering 1212 extends between the window 1252 and the recess 1206. FIGS. 14 and 15 illustrate how the shade 1246 and the curtain 1258 move to obscure the window 1252 while the tube 1244 and other components remain hidden from view above the visible surface of the access panel 1208. As shown in FIGS. 14 and 15, the system 1200 is usable even in situations where the ceiling does not already include a pocket to house the shade assembly 1202 and the curtain assembly 1204. Rather, a portion of the horizontal covering 1210 may be cut away, and the shade assembly 1202, the curtain assembly 1204, and the access panel 1208 may be attached to an upper structure 1212. This facilitates a reduction in construction costs and facilitates adding the system 1200 after initial construction of a structure is complete, as the system 1200 does not require a pre-constructed pocket. It should be understood, however, that the system 1200 may also be used in situations where the ceiling does already include a pocket prior to installation of the system 1200.

Referring now to FIG. 16, an illustration of a perspective cut-away view of the system 1200 is shown according to an alternative embodiment. The embodiment shown in FIG. 16 is substantially similar to the embodiment shown in FIG. 15, except that the curtain assembly 1204 is omitted. Accordingly, the recess 1206 may be smaller to accommodate only the shade assembly 1202. As shown in FIG. 16, both the gap 1236 and the gap 1238 remain, although the gap 1238 may decrease in size relative to the embodiment shown in FIG. 15. It will be appreciated that if the shade assembly 1202 or the curtain assembly 1204 is absent, the gap 1236 or the gap 1238 can also be absent, respectively.

Figure 17:
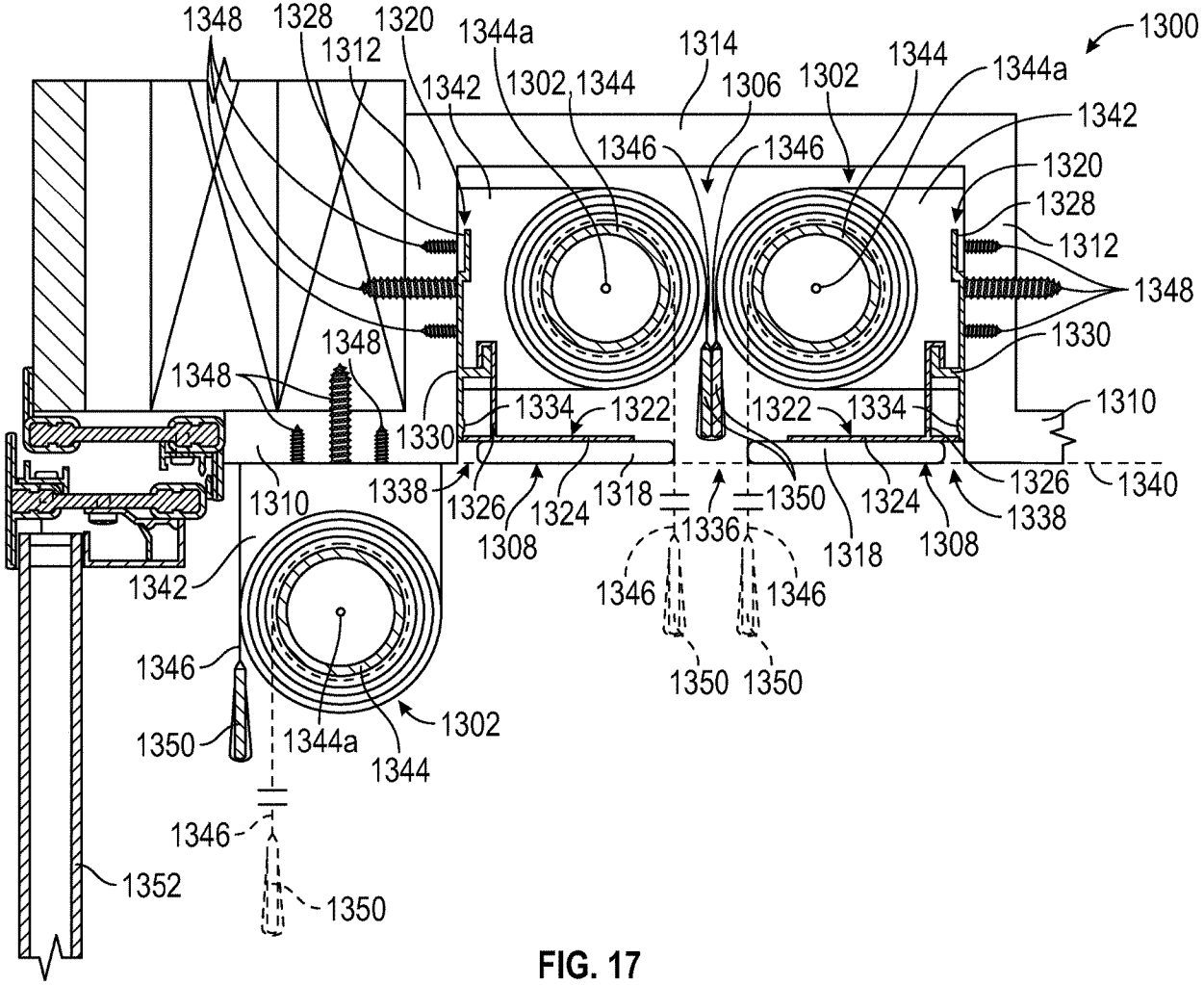
FIG. 17 is an illustration of a shade storage and deployment system according to an implementation described herein.

Referring to FIG. 17, an illustration of a side section view of a shade storage and deployment system 1300 is shown according to an exemplary embodiment. The system 1300 shares similarities with the system 1200, where similar reference numerals describe similar components. By way of example, the shade 1346 may be substantially similar to the shade 1246. The system 1300 omits any curtain assemblies (e.g., the curtain assembly 1204) and includes three shade assemblies 1302. Two of the shade assemblies 1302 are housed within a recess 1306 such that they are obscured from view, and a third shade assembly 1302 extends below the ceiling such that it is exposed (e.g., visible to an observer located below the ceiling). As shown in FIG. 17, shades 1346 within the recess 1306 extend along the center of the recess 1306. Accordingly, the system 1300 includes two access panels 1308 such that both of the shade assemblies 1302 are obscured while the gap 1336 between the access panels 1308 retains a sufficient width to accommodate both shades 1346 simultaneously. It should be appreciated that the shades 1346 of each shade assembly 1302 may have differing opacities. By way of example, each shade 1346 may be a blackout shade, thereby facilitating blocking all of the light emanating from the window 1352. By way of another example, the shades 1346 may each have a different opacity, thereby facilitating control of the amount of light capable of passing through the system 1300 by extending and retracting various combinations of the shades 1346.

Referring again to FIGS. 12A-D and FIGS. 13-16, in some embodiments, the control mechanism of the shade assembly 1202 and/or the motor 1276 or other control mechanism of the curtain assembly 1204 are configured to be controlled remotely. Each of the control mechanisms may include, for example, an infrared receiver, a Bluetooth receiver, a Wi-Fi receiver, a radio antenna, a wired connection, or another type of device configured to receive commands from a remote device over infrared communication, Bluetooth, Wi-Fi, radio communication, wired communication, or another type of communication. The remote device may be a remote control, a wall switch, a home automation system, a personal computer, a mobile device, or another type of controller. The commands from the remote device may include a desired position of the shade 1246 or the curtain 1258 and/or a desired direction and rate of movement of the shade 1246 or the curtain 1258.

In some embodiments, the shade assembly 1202 and/or the curtain assembly 1204 include a controller configured to control one or both of the control mechanisms. The controller may include various sensors (e.g., light sensors, movement sensors, etc.), timers, clocks, and/or other components to facilitate automation of the shade assembly 1202 and/or the curtain assembly 1204. By way of a first example, a controller including a light sensor may be configured to control the control mechanisms to move the shade 1246 and the curtain 1258 across the window 1252 in response to the light sensor detecting light of at least a threshold brightness entering through the window 1252. By way of another example, a controller including a clock may be configured to control the control mechanisms to move the shade 1246 and the curtain 1258 at predetermined times of the day. By way of yet another example, a controller including a movement sensor may be configured to control the control mechanisms to move the shade 1246 and the curtain 1258 away from the window 1252 upon detecting movement. In some embodiments, the controller is configured to receive commands or other information from the remote control. By way of example, the controller may be operatively coupled to a home automation system and configured to close the shade 1246 and/or the curtain 1258 in response to a projector (e.g., a television projector) receiving a startup command.

According to an alternative embodiment, the shade assembly 1202 is omitted from the system 1200, and the recess 1206 houses the curtain assembly 1204. In such an embodiment, the size of the recess 1206 may be minimized to accommodate the curtain assembly 1204 without the shade assembly 1202. Accordingly, the sizes of the spacer covering 1218 and the removable support 1222 may likewise be shortened. In such an embodiment, the gap 1236 can remain, but its size is decreased. In other embodiments, the spacer covering 1218 directly abuts the horizontal covering 1210, eliminating the gap 1236.

Although the shade assembly 1202, the curtain assembly 1204, and the access panel 1208 are shown as coupling directly to a component of the ceiling (e.g., the upper structure 1214, the beam 1216, etc.) it should be understood that components of the system 1200 may be indirectly coupled to a component of the ceiling. By way of example, the system 1200 may include a housing. The shade assembly 1202, the curtain assembly 1204 and/or the access panel 1208 may be coupled directly to the housing. The housing may then be inserted into the recess 1206 and coupled to a component of the ceiling. Such an embodiment facilitates assembly of some of the components of the system 1200 remotely (i.e., not in the ceiling).

Although the curtain assembly 1204 has been described herein as including a curtain 1258 to obscure the window 1252, it should be understood that the curtain 1258 may be replaced with another component or system of components that acts as a hanging cover configured to obscure the window 1252. By way of example, the curtain 1258 may be replaced with a number of individual vertical slats or blinds. In such an embodiment, the track 1254 and the hangers 1256 may be replaced with a track and hanger system suitable for use with vertical blinds. The hangers of this system may extend through the gap 1238 similarly to the hangers 1256, such that the track of the system is obscured by the access panel 1208 and the ceiling. Each hanger in such a system may be coupled to a single vertical slat. In some embodiments, the track and hanger system is configured to facilitate rotation of each vertical slat about a vertical axis simultaneously (e.g., in response to a user rotating a rod or pulling a cable).

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

The inventive concepts disclosed herein are not limited to the particular methodology, protocols, and expression of design elements, etc., described herein and as such may vary. The terminology used herein is for the purpose of describing particular embodiments only, and is not intended to limit the scope of the inventive concepts disclosed herein.

As used herein, the singular forms include the plural reference and vice versa unless the context clearly indicates otherwise. The term "or" is inclusive unless modified, for example, by "either." For brevity and clarity, a particular quantity of an item may be described or shown while the actual quantity of the item may differ. Other than in the operating examples, or where otherwise indicated, all numbers expressing measurements used herein should be understood as modified in all instances by the term "about," allowing for ranges accepted in the art.

Unless defined otherwise, all technical terms used herein have the same meaning as those commonly understood to one of ordinary skill in the art to which the inventive concepts disclosed herein pertain. Although any known methods, devices, and materials may be used in the practice or testing of the inventive concepts disclosed herein, the methods, devices, and materials in this regard are described herein.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that modifications or alterations of the subject matter described and claimed are considered to be within the scope of the inventive concepts disclosed herein as recited in the appended claims.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure.

What is claimed is:

1. A shade and curtain storage and deployment system, comprising:

a shade assembly disposed at least partially within a recess formed in a ceiling, the shade assembly including a shade movable between a retracted position and an extended position;

a curtain assembly disposed at least partially within the recess, the curtain assembly including:

a curtain movable between a fully retracted position and a fully extended position; and a track having a plurality of hangers configured to translate on the track and support the curtain; and an access panel disposed within the recess such that a visible surface of the access panel occupies substantially the same plane as a visible surface of the ceiling surrounding the recess, wherein a first gap is provided between a first edge of the access panel and the ceiling, wherein a second gap is provided between a second edge of the access panel and the ceiling, wherein the first gap is configured to enable the shade to extend through the first gap from the recess to an area below the ceiling when the shade is in the extended position, and wherein the second gap is configured to enable the curtain to extend along the second edge between the fully retracted position and the fully extended position to at least partially obscure the shade;

wherein the track extends along the second edge, and wherein the track is disposed entirely above the plane occupied by the visible surface of the access panel.

2. The shade and curtain storage and deployment system of claim 1, wherein a portion of the access panel extends directly beneath the track.

3. The shade and curtain storage and deployment system of claim 2, wherein a portion of the ceiling extends directly beneath the track such that a width of the second gap is less than a width of the track.

4. The shade and curtain storage and deployment system of claim 1, wherein the curtain is disposed entirely below the plane occupied by the visible surface of the access panel, and wherein the hangers extend below the plane occupied by the visible surface of the access panel to couple with the curtain.

5. The shade and curtain storage and deployment system of claim 1, wherein the access panel is selectively coupled to a support and wherein the access panel is configured to be decoupled from the support when a substantially vertical force is applied to the access panel.

6. The shade and curtain storage and deployment system of claim 5, wherein the access panel includes a first attachment member extending upward into the recess, wherein the support includes a second attachment member extending from a base, and when the access panel is coupled to the support, the first attachment member engages the second attachment member such that the second attachment member supports at least a portion of a weight of the access panel and the base rests against a side surface of the access panel.

7. The shade and curtain storage and deployment system of claim 6, wherein the access panel extends directly beneath the base of the support, and wherein the access panel is vertically offset from the base such that a third gap is defined between the base and the portion of the access panel positioned directly below the base.

8. The shade and curtain storage and deployment system of claim 1, wherein the access panel comprises the same or similar material as the visible surface of the ceiling such that the visible surface of the access panel and the visible surface of the ceiling are visually substantially identical.

9. The shade and curtain storage and deployment system of claim 1, wherein a contour of the access panel matches a contour of the visible surface of the ceiling.

10. The shade and curtain storage and deployment system of claim 1, further comprising a control mechanism extending below the plane occupied by the visible surface of the access panel, wherein the control mechanism is configured to move the curtain between the fully retracted position and the fully extended position.

11. A shade and hanging cover storage and deployment system, comprising:

a hanging cover assembly disposed at least partially within a recess formed in a ceiling, the hanging cover assembly including:

a hanging cover movable between a fully retracted position and a fully extended position, wherein the hanging cover is configured to block light emanating from a window when in the fully extended position; and a track having a plurality of hangers configured to translate on the track and support the hanging cover; and a shade assembly including a shade movable between a retracted position and an extended position, wherein the shade is configured to block light emanating from the window when moved into the extended position; and an access panel disposed within the recess such that a visible surface of the access panel occupies substantially the same plane as a visible surface of the ceiling surrounding the recess, wherein a gap is provided between an edge of the access panel and the ceiling, wherein the gap is configured to enable the hanging cover to extend along the edge between the fully retracted position and the fully extended position;

wherein the access panel is selectively coupled to a support and wherein the access panel is configured to be decoupled from the support when a substantially vertical force is applied to the access panel; and wherein the track extends along the edge, wherein the track is disposed entirely above the plane occupied by the visible surface of the access panel, and wherein a portion of the access panel extends directly beneath the track.

12. The shade and hanging cover storage and deployment system of claim 11, wherein a portion of the ceiling extends directly beneath the track such that a width of the gap is less than a width of the track.

13. The shade and hanging cover storage and deployment system of claim 11, wherein the hanging cover is disposed entirely below the plane occupied by the visible surface of the access panel, and wherein the hangers extend below the plane occupied by the visible surface of the access panel to couple with the hanging cover.

14. The shade and hanging cover storage and deployment system of claim 11, wherein the access panel includes a first attachment member extending upward into the recess, wherein the support includes a second attachment member extending from a base, and when the access panel is coupled to the support, the first attachment member engages the second attachment member such that the second attachment member supports at least a portion of a weight of the access panel and the base rests against a side surface of the access panel.

15. The shade and hanging cover storage and deployment system of claim 11, wherein the access panel comprises the same or similar material as the visible surface of the ceiling such that the visible surface of the access panel and the visible surface of the ceiling are visually substantially identical.

16. The shade and hanging cover storage and deployment system of claim 11, wherein a contour of the access panel matches a contour of the visible surface of the ceiling.

17. A shade and hanging cover storage and deployment system, comprising:

a shade assembly disposed at least partially within a first area of a volume defined within a ceiling, the shade assembly including a shade movable between a retracted position and an extended position;

a hanging cover assembly disposed at least partially within a second area of the volume, the hanging cover assembly including:

a hanging cover movable between a fully retracted position and a fully extended position; and a track having a plurality of hangers configured to translate on the track and support the hanging cover; and an access panel coupled to the ceiling and extending along a side of the volume, wherein a first gap is provided between a first edge of the access panel and the ceiling, wherein a second gap is provided between a second edge of the access panel and the ceiling, wherein the first gap is configured to enable the shade to extend through the first gap from the volume to an area below the ceiling when the shade is in the extended position, and wherein the second gap is configured to enable the hanging cover to extend along the second edge between the fully retracted position and the fully extended position to at least partially obscure the shade;

wherein the first and second areas of the volume are fluidly coupled within the ceiling such that the volume contains the hanging cover assembly and the shade assembly.

18. The shade and hanging cover storage and deployment system of claim 17, wherein a portion of the access panel and a portion of the ceiling extend beneath the track such that a width of the second gap is less than a width of the track.

19. The shade and hanging cover storage and deployment system of claim 17, wherein the access panel is selectively coupled to a support and wherein the access panel is configured to be decoupled from the support when a substantially vertical force is applied to the access panel.

20. The shade and hanging cover storage and deployment system of claim 19, wherein the access panel includes a first attachment member extending upward into the volume, wherein the support includes a second attachment member extending from a base, and when the access panel is coupled to the support, the first attachment member engages the second attachment member such that the second attachment member supports at least a portion of a weight of the access panel and the base rests against a side surface of the access panel.

* * * * *